US007145450B2

(12) United States Patent
Brown

(10) Patent No.: US 7,145,450 B2
(45) Date of Patent: Dec. 5, 2006

(54) COMPACTOR SERVICE AND MONITORING SYSTEM

(76) Inventor: William J. Brown, 308 Southampton Dr., Rochester, NY (US) 14616

( * ) Notice: Subject to any disclaimer, the term of this patent is extended or adjusted under 35 U.S.C. 154(b) by 111 days.

(21) Appl. No.: 10/856,917

(22) Filed: May 28, 2004

(65) Prior Publication Data

US 2005/0275556 A1 Dec. 15, 2005

(51) Int. Cl.
*G08B 29/00* (2006.01)

(52) U.S. Cl. ..... 340/506; 340/612; 340/613; 340/614

(58) Field of Classification Search ..... 340/506, 340/612, 613, 614
See application file for complete search history.

(56) References Cited

U.S. PATENT DOCUMENTS

| | | | | |
|---|---|---|---|---|
| 4,044,664 | A | 8/1977 | Budoff | |
| 4,603,625 | A | 8/1986 | Brown | |
| 4,643,087 | A | 2/1987 | Fenner et al. | |
| 4,735,136 | A | 4/1988 | Lee et al. | |
| 4,773,027 | A | 9/1988 | Neumann | |
| 4,781,111 | A | 11/1988 | Chesnut | |
| 4,953,109 | A | 8/1990 | Burgis | |
| 5,004,392 | A | 4/1991 | Naab | |
| 5,016,197 | A | 5/1991 | Neumann et al. | |
| 5,117,373 | A | 5/1992 | Huff | |
| 5,173,866 | A | 12/1992 | Neumann et al. | |
| 5,214,594 | A | 5/1993 | Tyler et al. | |
| 5,299,142 | A | 3/1994 | Brown et al. | |
| 5,299,493 | A | 4/1994 | Durbin et al. | |
| 5,303,642 | A | 4/1994 | Durbinet et al. | |
| 5,473,312 | A | 12/1995 | Duran | |
| 5,548,535 | A | 8/1996 | Zvonar | |
| 5,558,013 | A | 9/1996 | Blackstone, Jr. | |
| 5,967,028 | A | 10/1999 | Schomisch et al. | |
| 6,003,441 | A | 12/1999 | Little | |
| 6,055,902 | A | 5/2000 | Harrop et al. | |
| 6,123,017 | A | 9/2000 | Little | |
| 6,360,186 | B1 | 3/2002 | Durbin | |
| 6,367,377 | B1 | 4/2002 | Gawley | |
| 6,408,261 | B1 | 6/2002 | Durbin | |
| 6,448,898 | B1 | 9/2002 | Kasik | |
| 6,453,270 | B1 | 9/2002 | Durbin | |
| 6,462,654 | B1 * | 10/2002 | Sandelman et al. | 340/506 |
| 6,510,376 | B1 | 1/2003 | Burnstein | |
| 6,561,085 | B1 | 5/2003 | Durbin et al. | |
| 6,591,296 | B1 | 7/2003 | Ghanime | |
| 6,687,656 | B1 | 2/2004 | Durbin et al. | |
| 6,738,732 | B1 | 5/2004 | Durbin et al. | |

* cited by examiner

*Primary Examiner*—Daryl C Pope
(74) *Attorney, Agent, or Firm*—Brown & Michaels, PC

(57) ABSTRACT

In this compactor service and monitoring system, compactor fullness and other critical parameters are monitored by an on-site processor. Compactor fullness is monitored using a pressure sensor capable of measuring hydraulic fluid system pressure for a compactor ram during a compactor compaction cycle. The processor generates a message indicating the compactor is full when the pressure is at least equal to a preset pressure for a preset time during a compaction cycle. Messages are sent via a wireless transmitter to a receiver that converts these messages into internet messages and directs them to a computer server database system. This system creates a work order in response to the message and sends the work order to a service provider via email. The email contains a link back to the database system web-site for tracking services provided by the recipient.

25 Claims, 35 Drawing Sheets

WMS Software processes the request and creates a workorder & email message to the service provider (Hauler or Maintenance Company)

FIG. 4G1

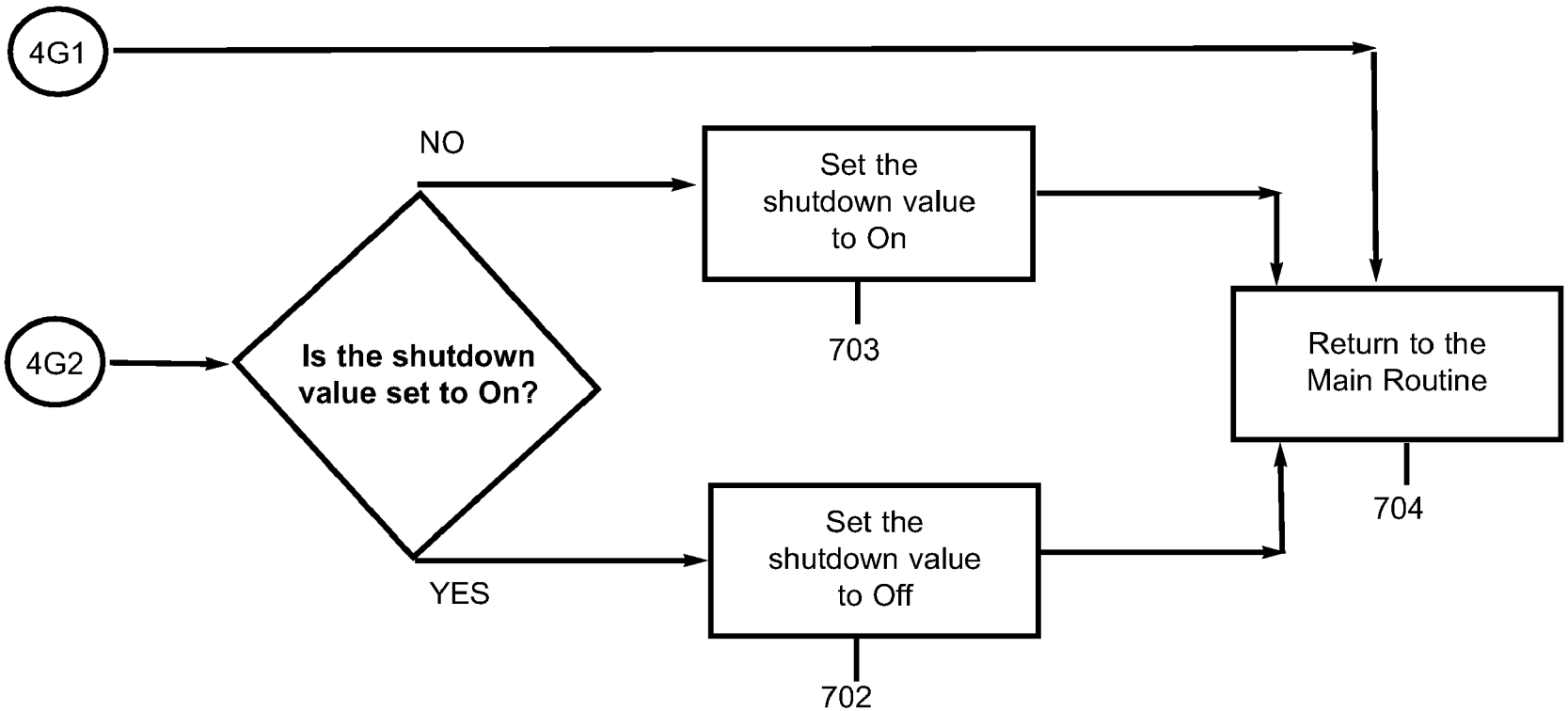
FIG. 4G2

FIG. 4I1

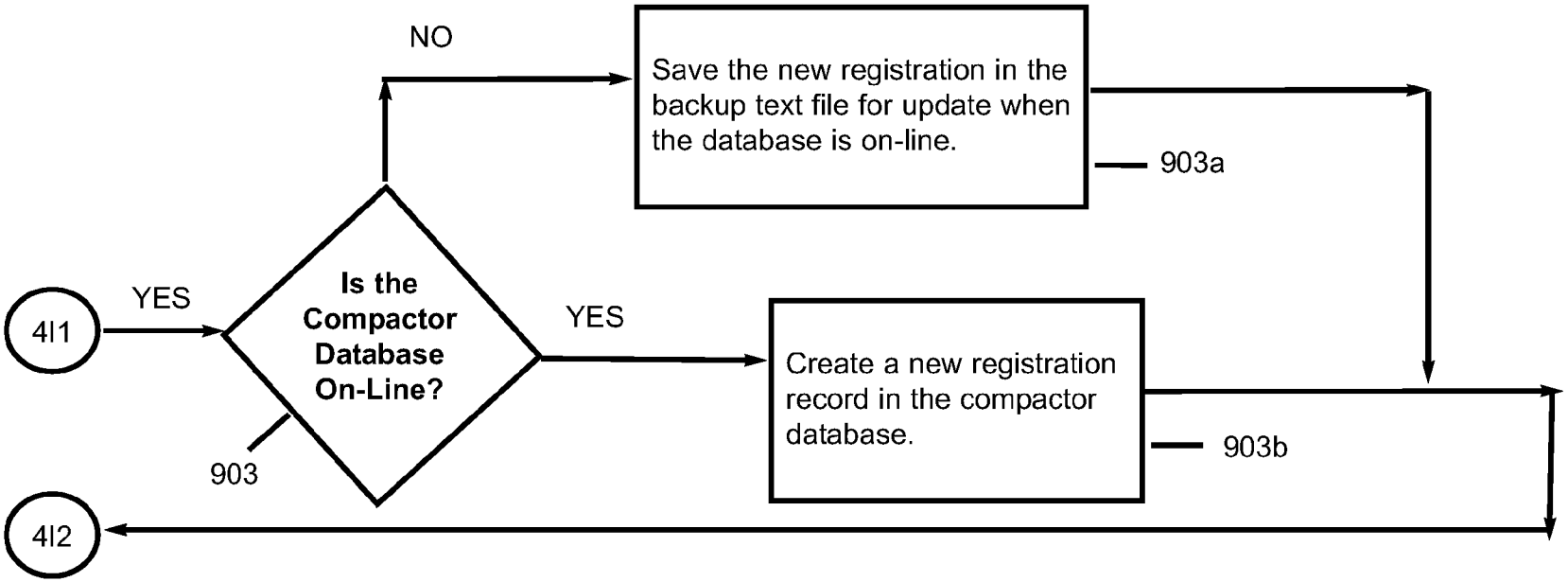
FIG. 4I2

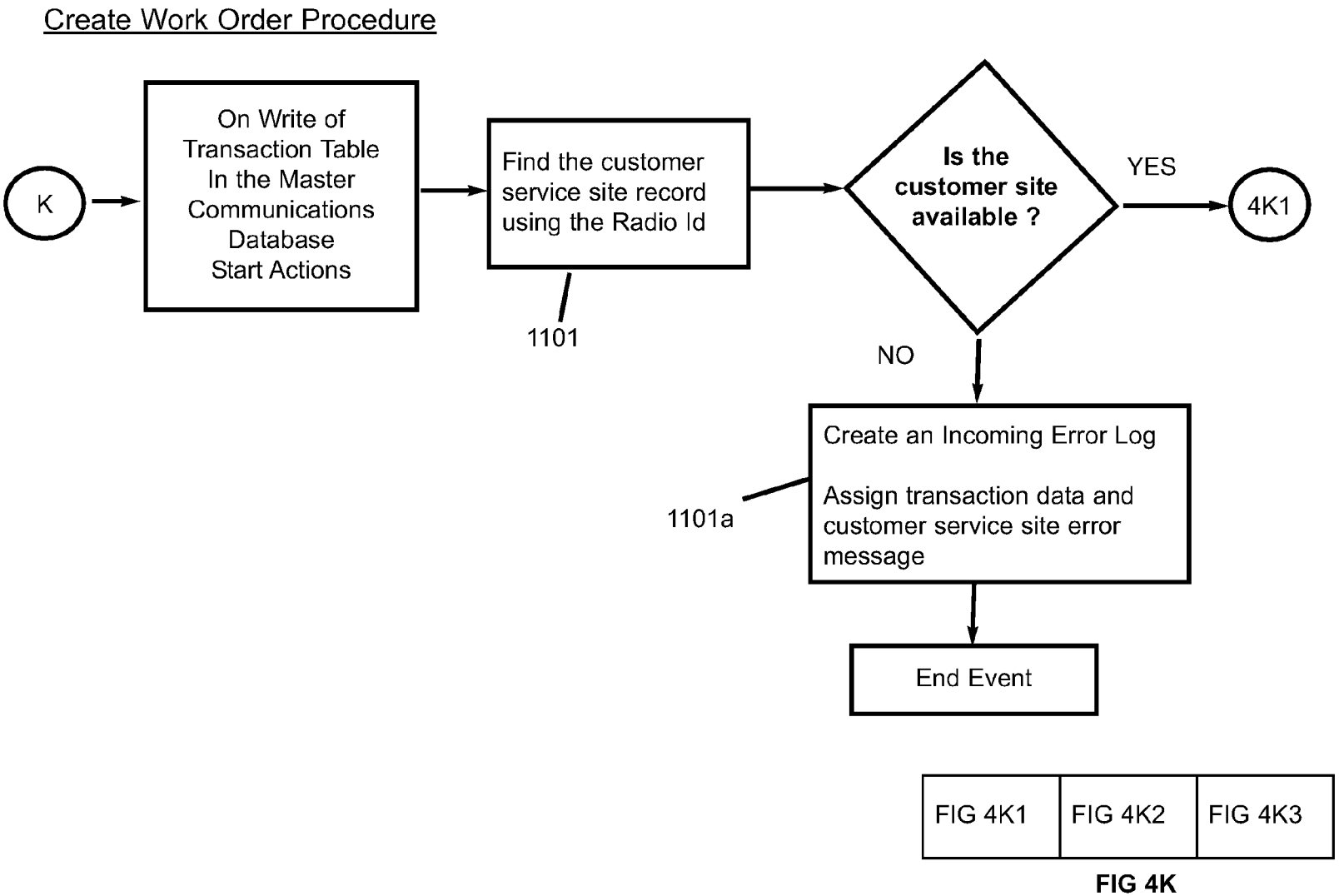
FIG. 4K1

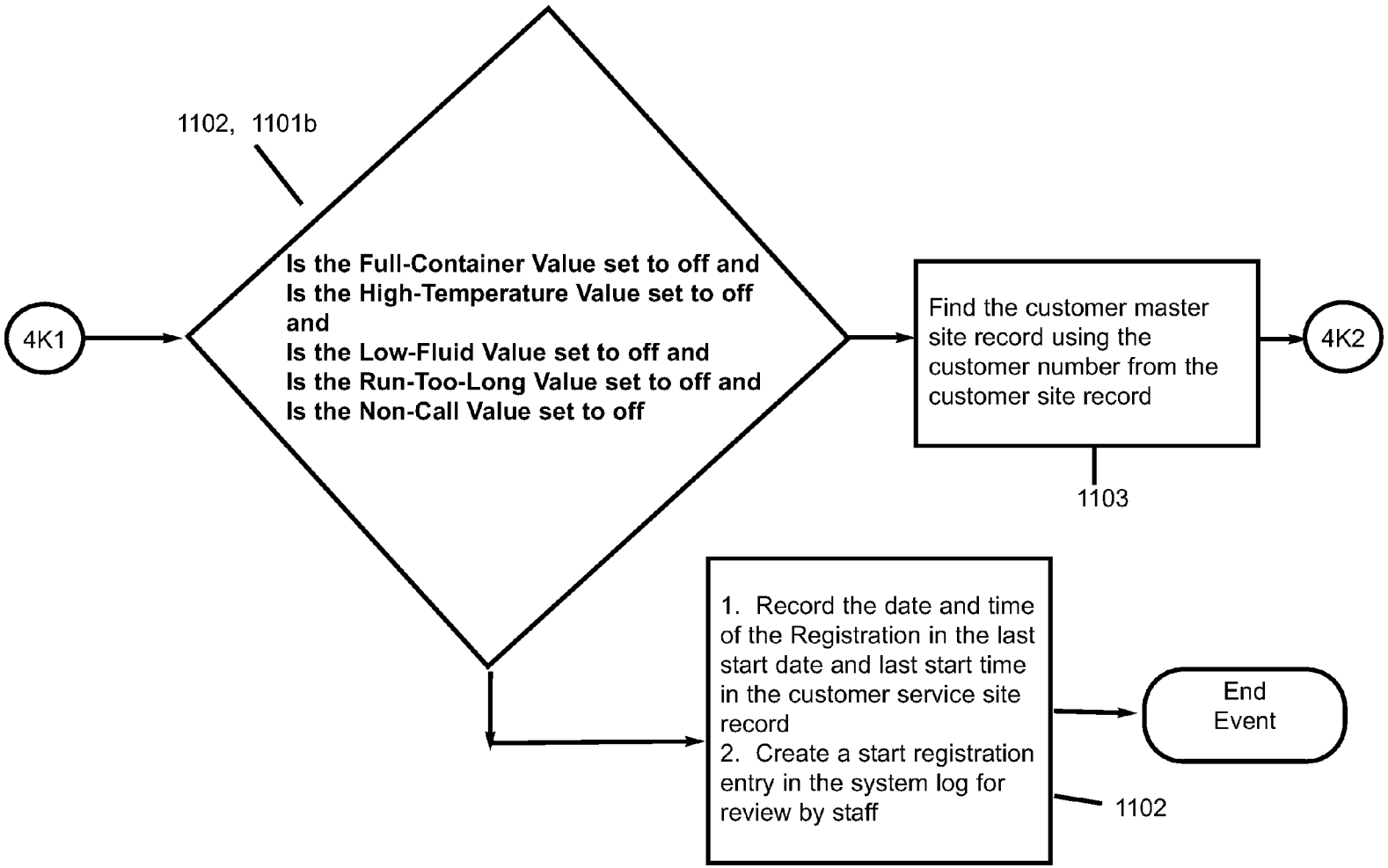
FIG. 4K2

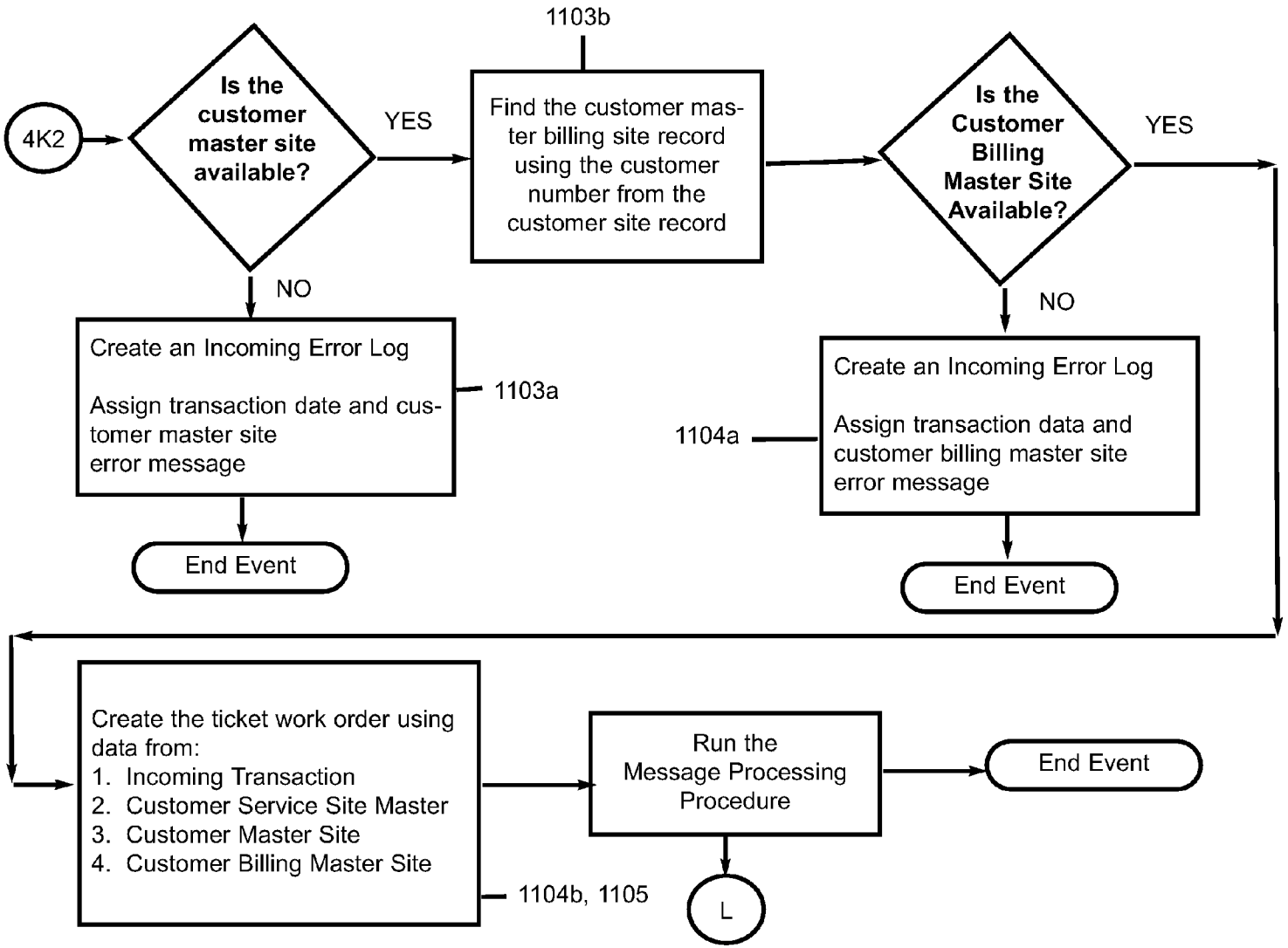
FIG. 4K3

FIG. 4L1

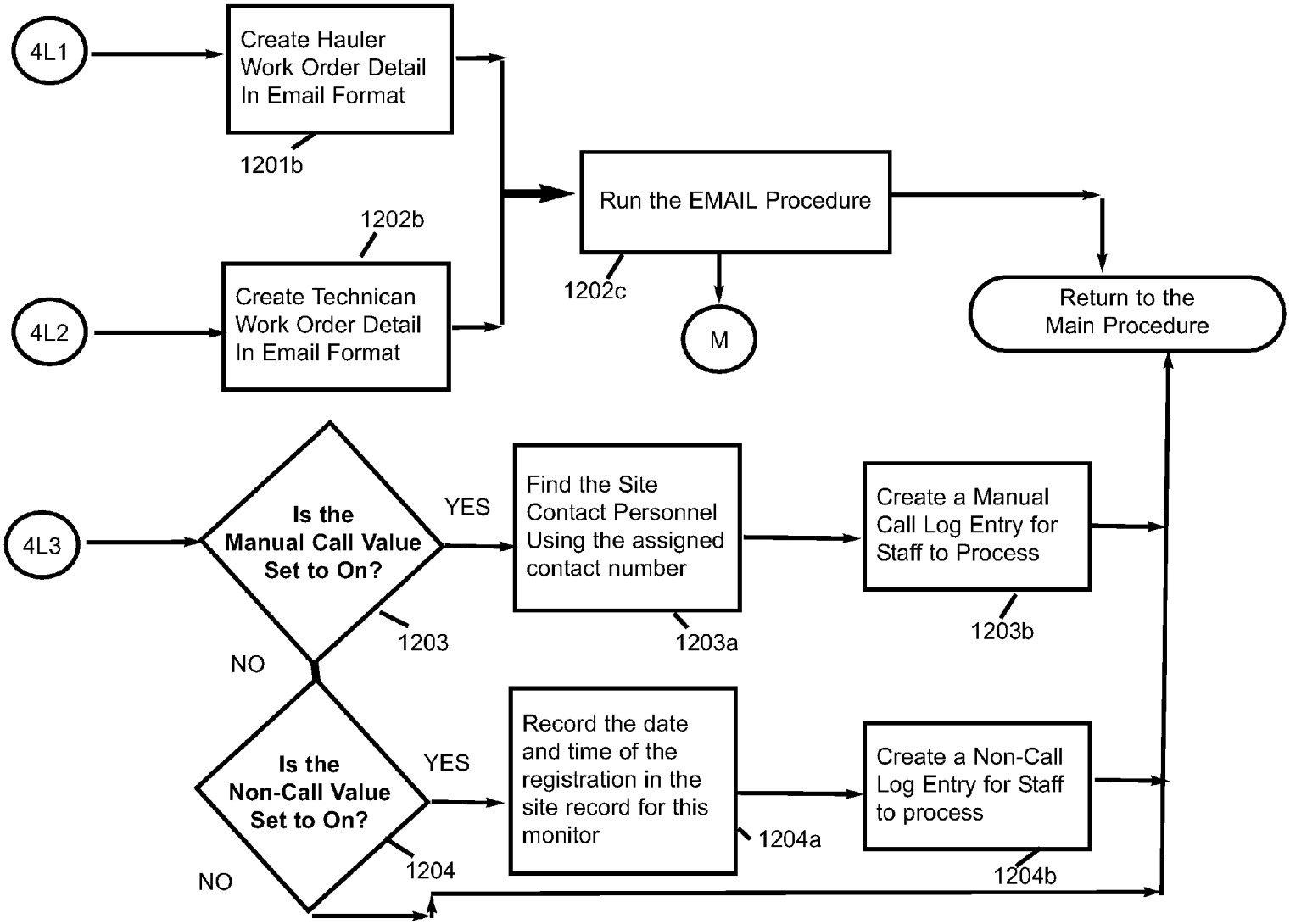
FIG. 4L2

Email Procedure

FIG. 4M1

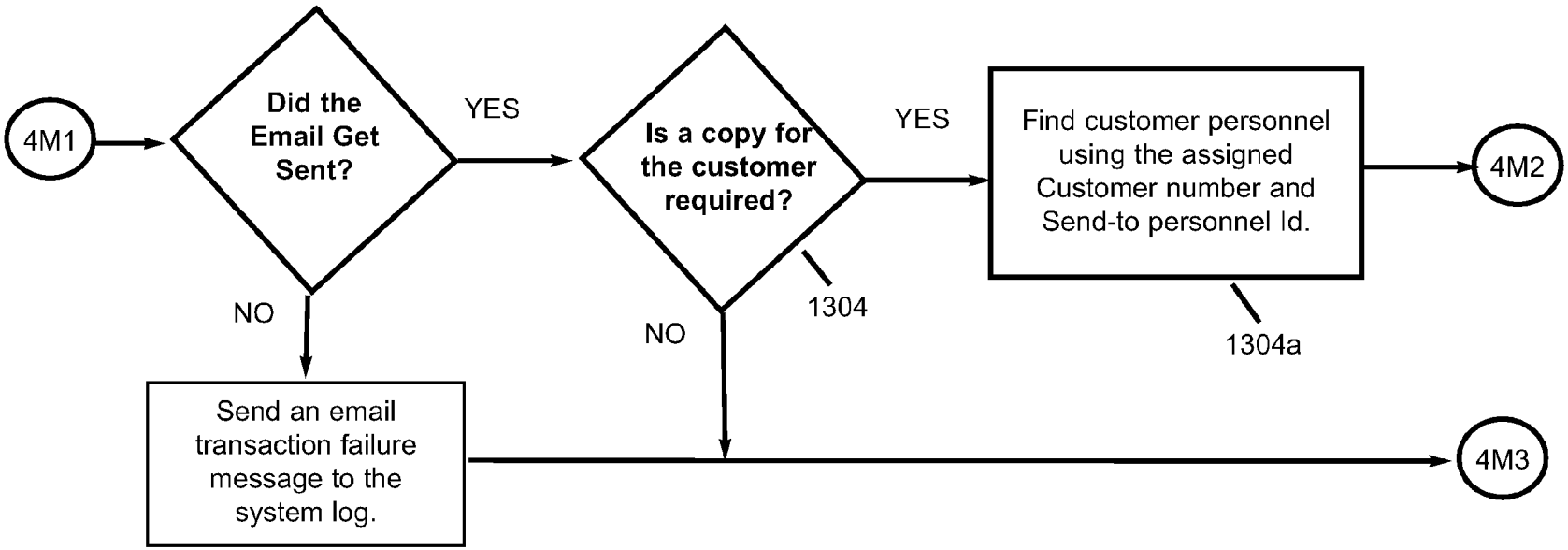
FIG. 4M2

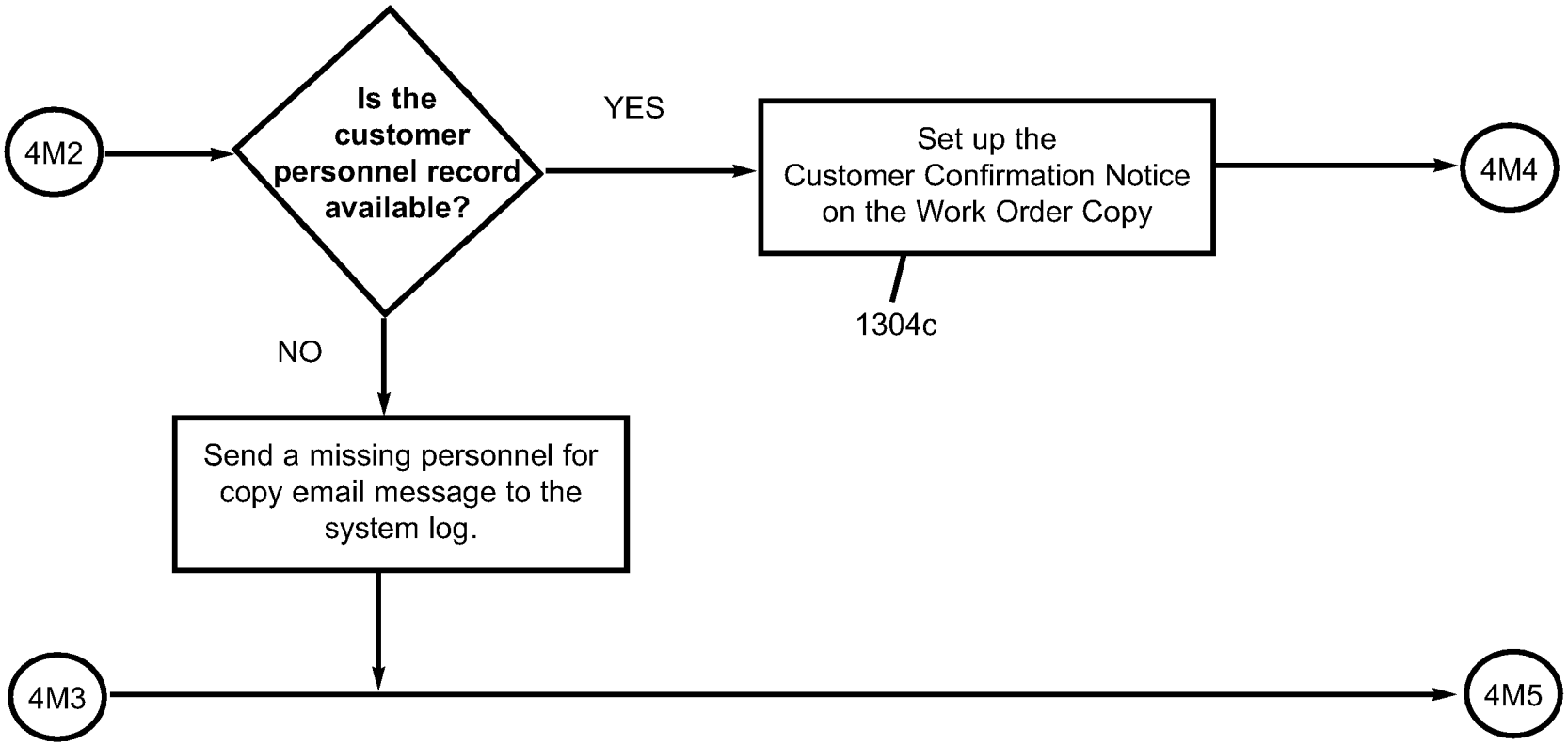
FIG. 4M3

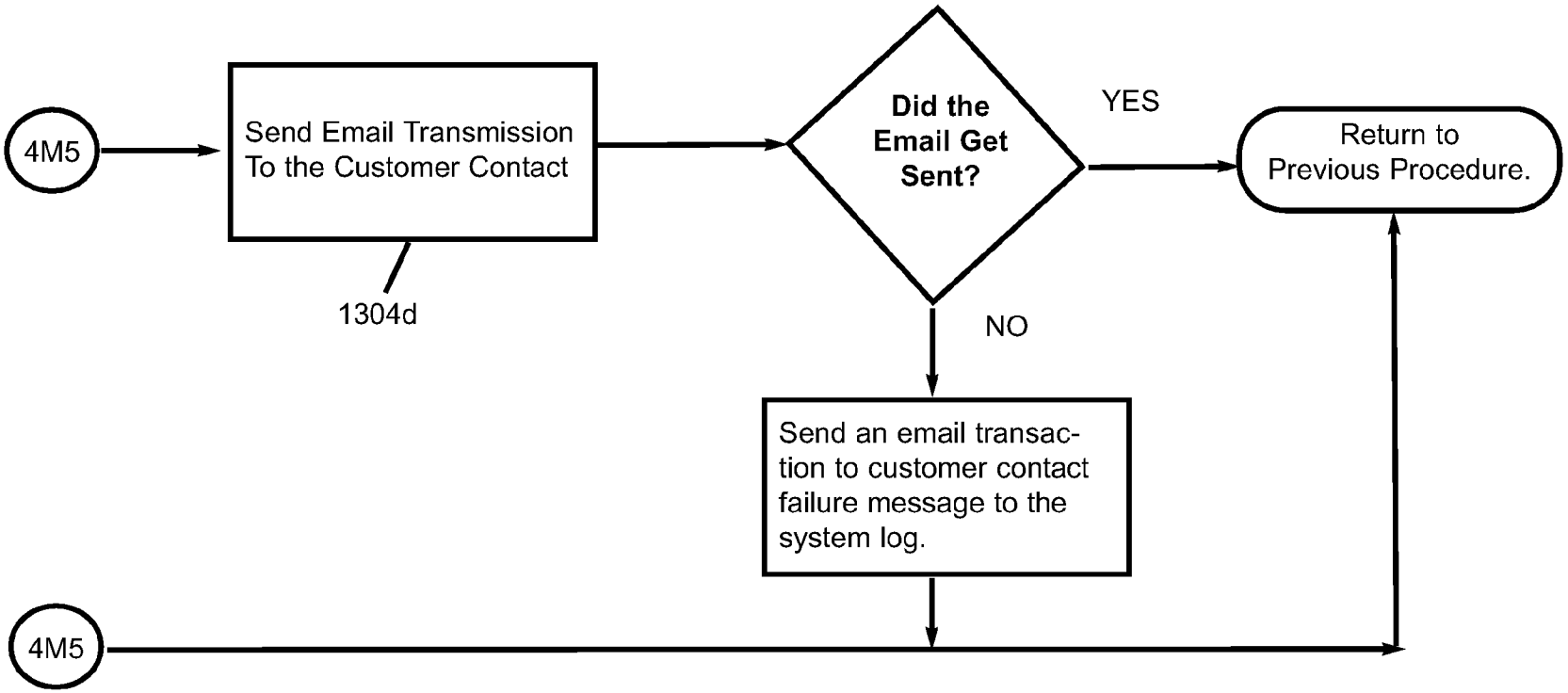
FIG. 4M4

FIG. 4N1

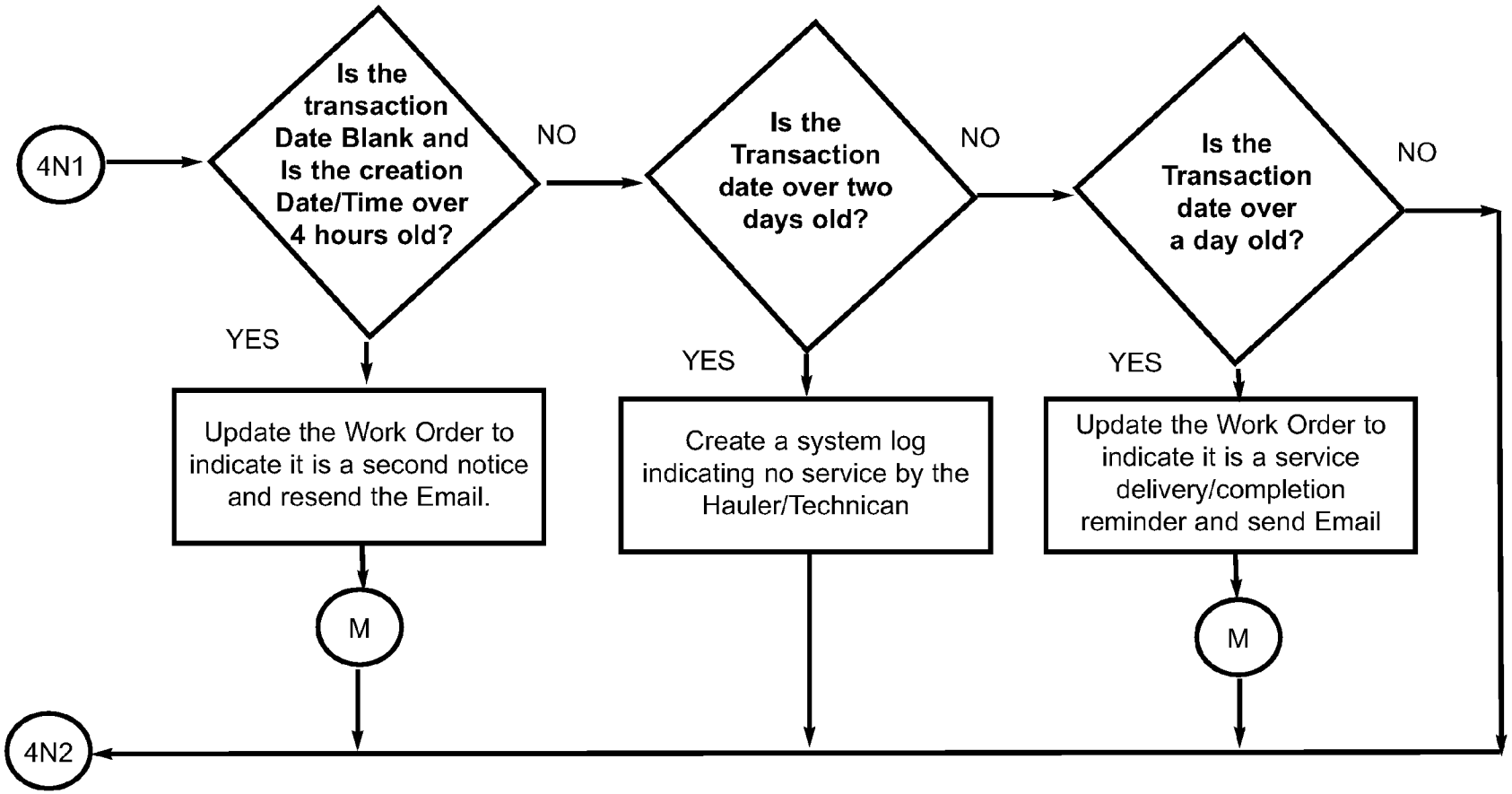
FIG. 4N2

FIG. 4O1

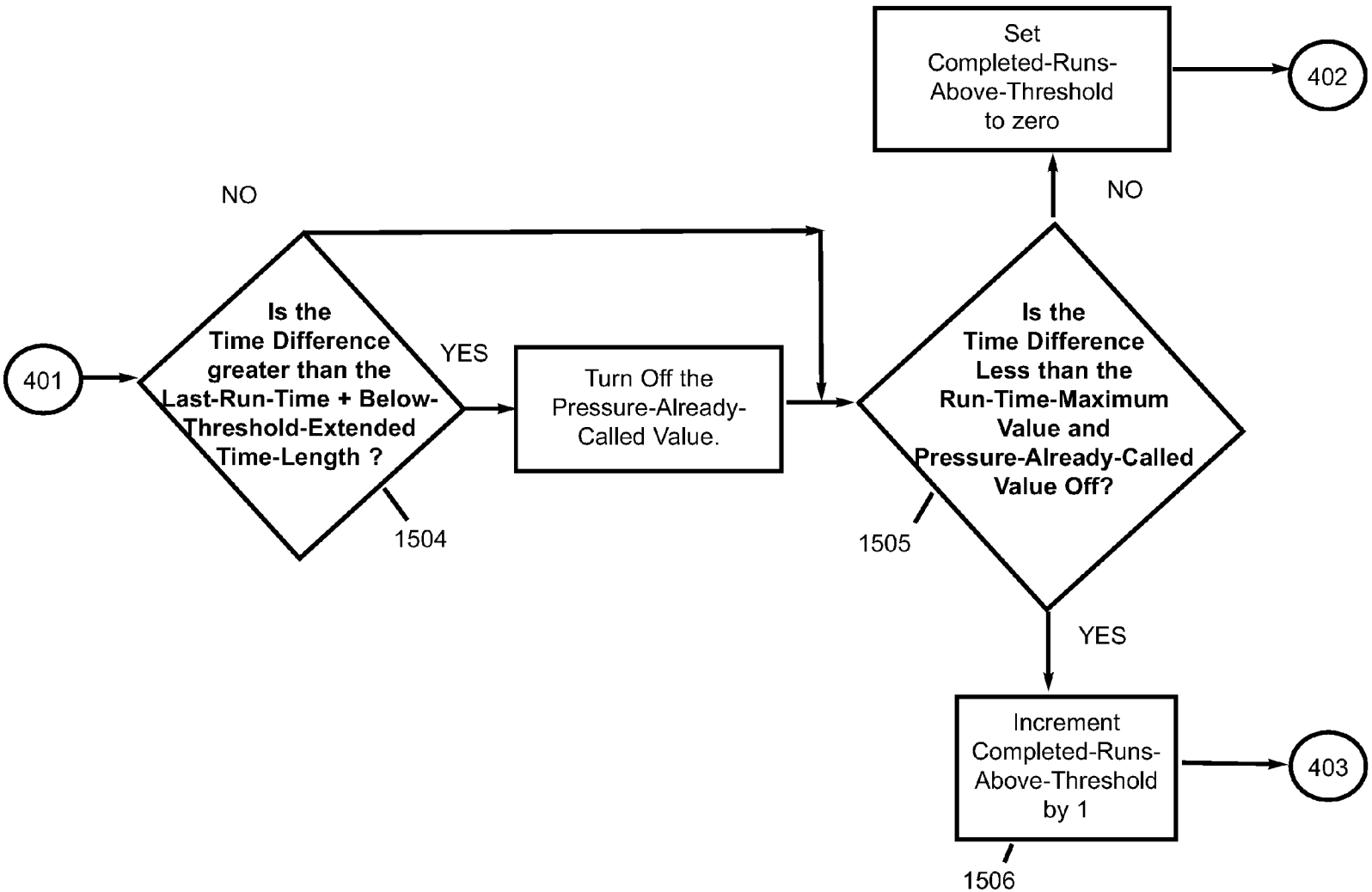
FIG. 4O2

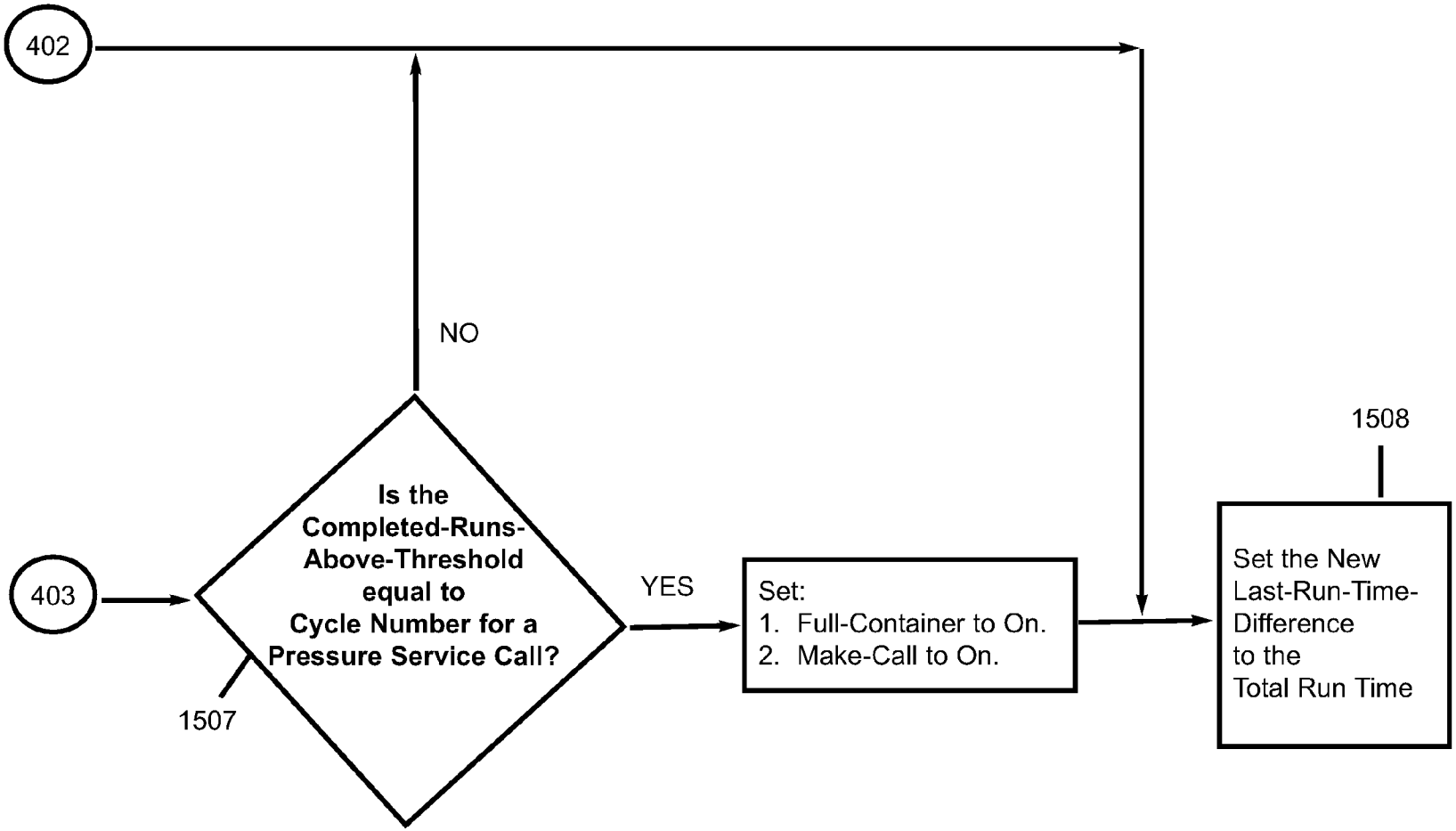
FIG. 4O3

FIG. 4P1

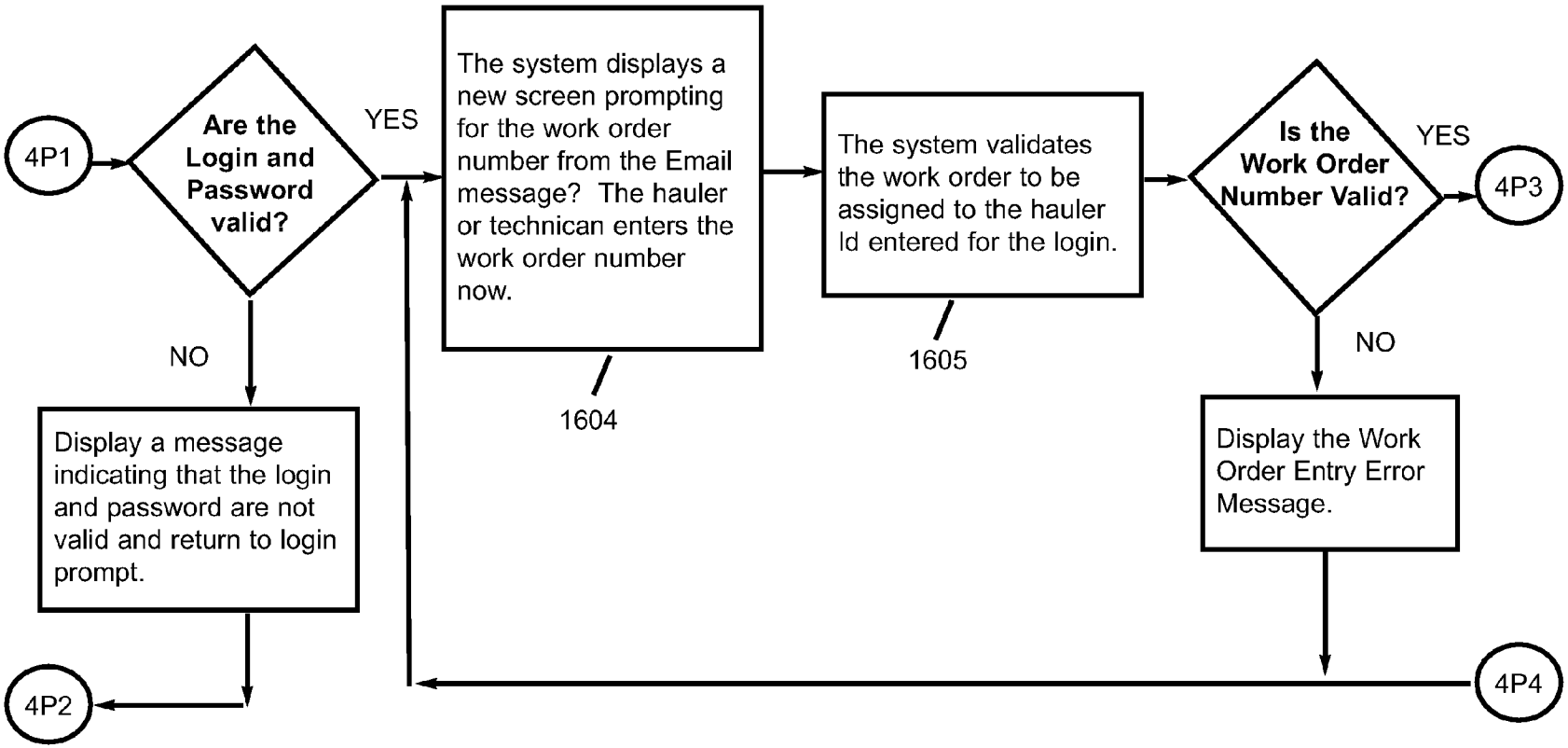
FIG. 4P2

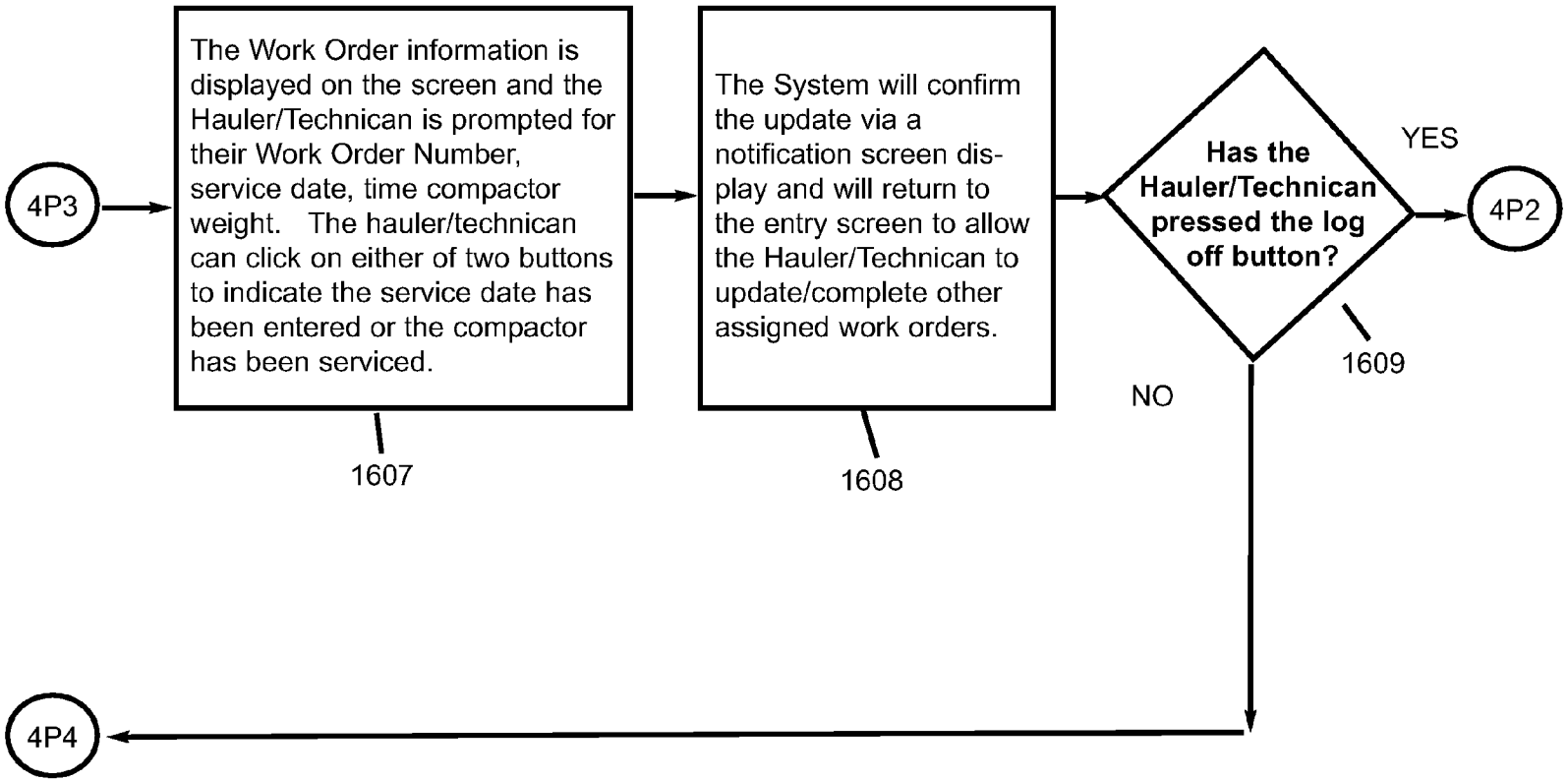
FIG. 4P3

FIG. 4Q1

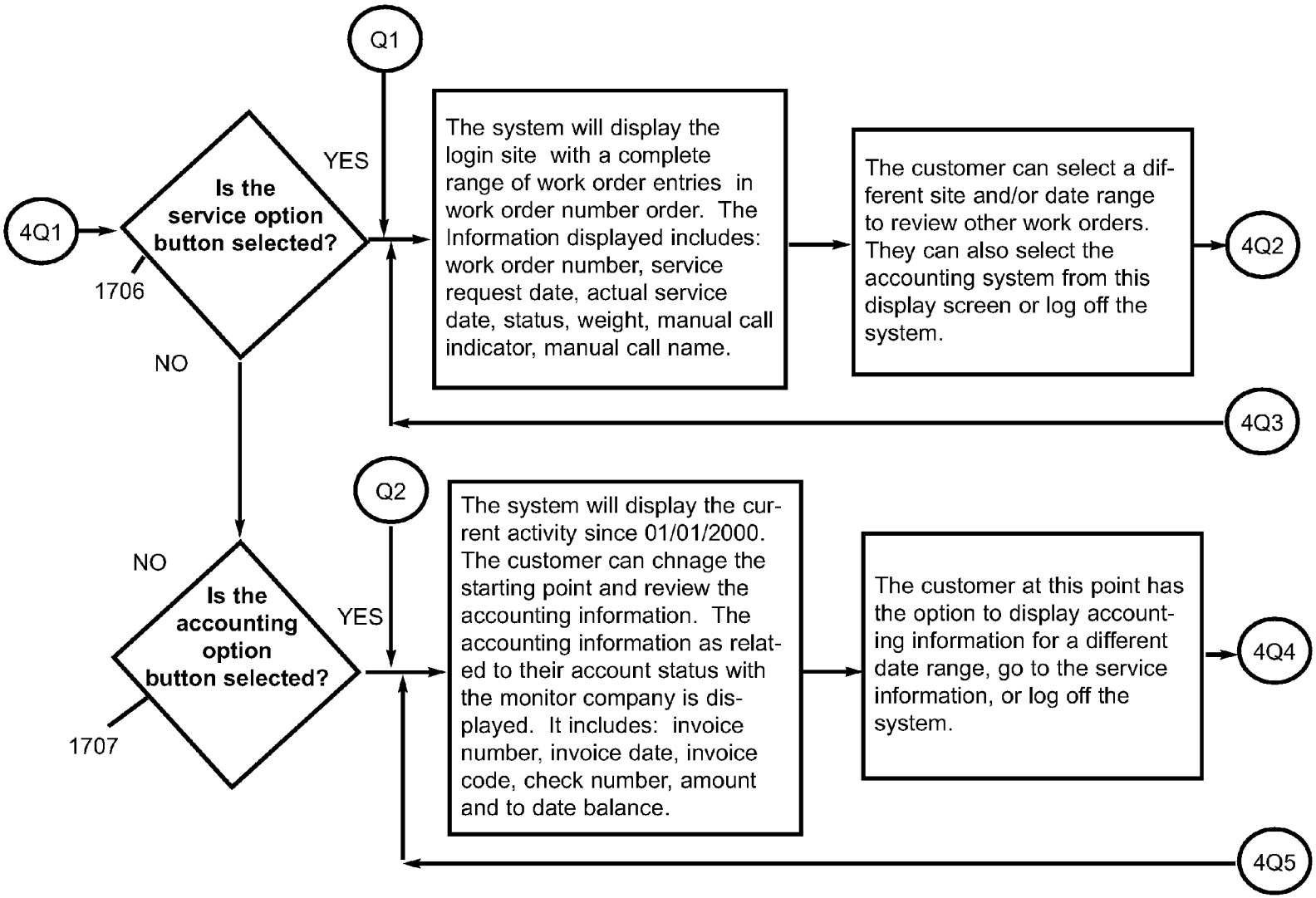
FIG. 4Q2

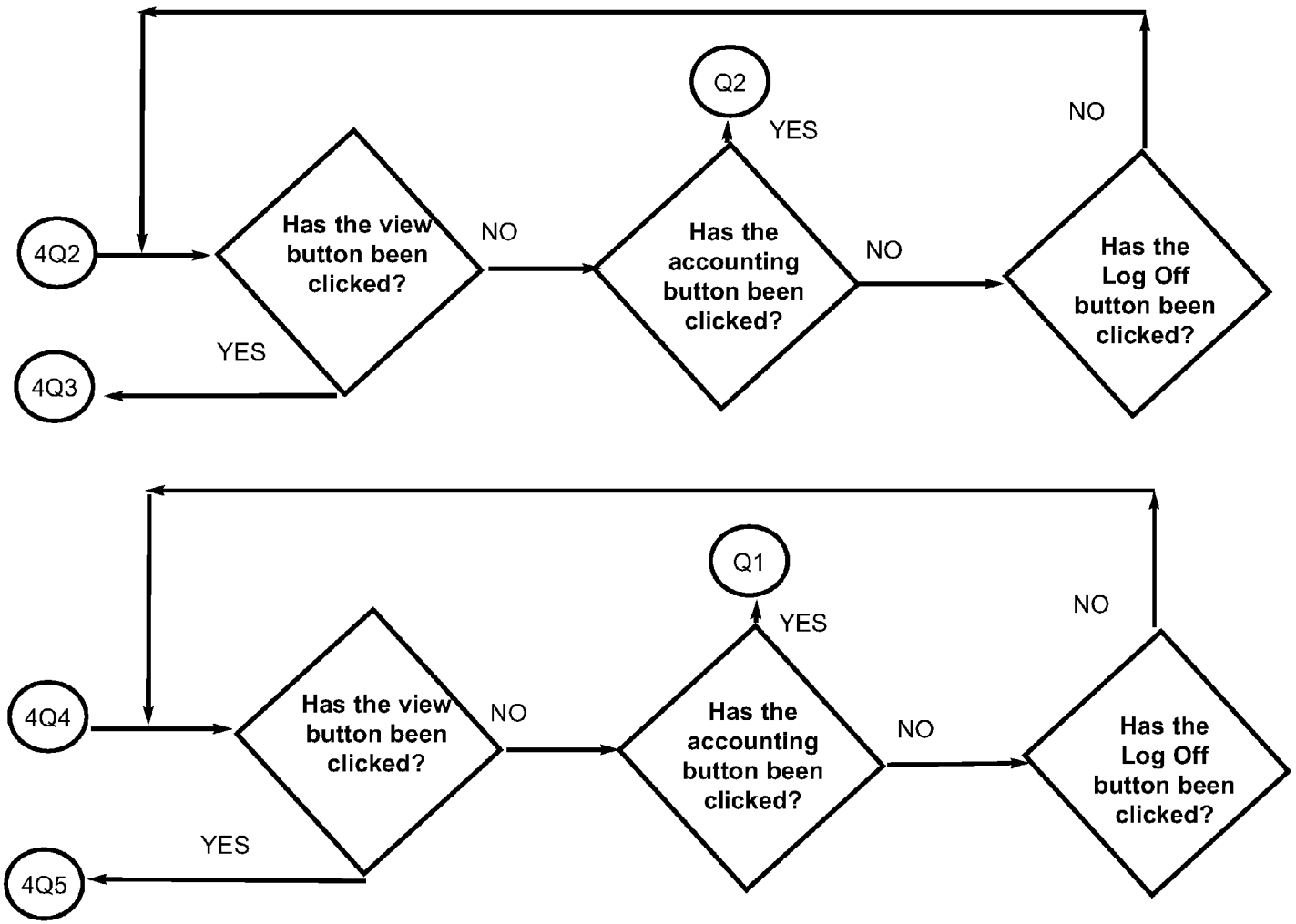
FIG. 4Q3

COMPACTOR SERVICE AND MONITORING SYSTEM

BACKGROUND OF THE INVENTION

1. Field of the Invention

The invention pertains to the field of waste compactor monitoring and servicing systems. More particularly, it pertains to a compactor service and monitoring system using an on-site monitor to relay wireless data related to compactor status to a receiver re-conveying this data via internet to an off-site computer server database which provides a work order by email for appropriate service to a service provider.

2. Description of Related Art

There have been numerous patents dealing with waste compactor monitoring and servicing systems. Representative examples of such patents include:

U.S. Pat. No. 5,299,142 issued to Brown in 1994 for a "Method and Apparatus for Determining the Fullness of a Waste Compactor."

U.S. Pat. No. 5,299,142 issued to Durbin in 1994 for "System for Monitoring Trash Compactors."

U.S. Pat. No. 5,473,312 issued to Duran in 1995 for a "Full Container Recognition System."

U.S. Pat. No. 6,360,186 issued to Durbin in 2002 for "Systems for Remote Management of a Network of Waste Containers."

U.S. Pat. No. 6,408,261 issued to Durbin in 2002 for "Systems for Remote Management of a Network of Waste Containers."

U.S. Pat. No. 6,561,085 issued to Durbin in 2003 for a "System and Method for Variably Adjusting the Pick-Up Level of One or More Waste Compactor Containers."

However, there is a continuing need for innovation and improvement in this area so as to better serve the needs of the public in an effective, timely and cost effective manner.

SUMMARY OF THE INVENTION

In the preferred embodiment of my invention described herein, compactor fullness and/or other critical parameters are monitored by an on-site programmable processor that conveys messages on these parameters via a wireless transmitter to a receiver that converts these messages into internet messages. These messages are, preferably, directed to the computer server database system of my design so that they can be forwarded to appropriate destinations via email.

One aspect of my invention relates to a novel method and apparatus for measuring compactor fullness. Here I use a pressure sensor capable of measuring hydraulic fluid system pressure for a compactor ram during a compactor compaction cycle. This works in conjunction with the processor, which receives the measured pressure from the pressure sensor during said compaction cycle. The processor runs a software program monitoring the measured pressure, and generates and sends a message to an intended recipient indicating the compactor is full when the pressure is at least equal to a programmed preset pressure for a programmed preset time during a compaction cycle.

Other aspects of my invention relate to the manner in which this message is sent, and are also novel to my invention. A message is initially sent by a wireless transmitter, preferably a cellular radio transmitter, to a receiver that converts the message into an internet message. This message could be addressed directly to the recipient, however, another aspect of my invention is the use of a computer server database system for processing and tracking work orders and services delivered. Thus, the message is instead sent via the internet to a computer server database system that receives the message, creates a work order in response to the message, and sends the work order to the intended recipient via email. The email contains a link back to the database system for tracking services provided by the intended recipient.

BRIEF DESCRIPTION OF THE DRAWINGS

FIG. 1 provides a schematic diagram of the on-site elements of my invention and their connection to a compactor.

FIG. 2 provides a first schematic diagram of on-site and off-site elements, focusing particularly on the wireless to internet connection between on-site elements and the data server of my invention.

FIG. 3 provides a second schematic diagram of on-site and off-site elements, focusing particularly on the internet connection between the data server of my invention and service providers for the compactor.

FIG. 4 A illustrates the main monitor routine of my invention, which repeats a set of instructions to check several values including sensor and program variables to determine a need to service the compactor.

FIG. 4B illustrates the pressure check subroutine referenced at "B" of FIG. 4A.

FIG. 4C illustrates the high temperature check subroutine referenced at "C" of FIG. 4A.

FIG. 4D illustrates the low fluid check subroutine referenced at "D" of FIG. 4A FIG. 4E illustrates the manual call check subroutine referenced at "E" of FIG. 4A.

FIG. 4F illustrates a subroutine to check how long it has been since a message has been sent to the communications server as referenced at "F" of FIG. 4A.

FIG. 4G illustrates a subroutine to check whether a request to shutdown or start up has been received from the communications server as referenced at "G" of FIG. 4A.

FIG. 4H illustrates a subroutine to generate a service request call back to the communications server as referenced at "H" of FIG. 4A.

FIGS. 4I through 4N and 4P through 4Q relate to the communication server aspects of my invention.

FIG. 4I illustrates the new registration receiver routine of the communication server of my invention.

FIG. 4J illustrates the new registration processing subroutine of my invention that monitors the compactor database table for the existence of new registrations.

FIG. 4K illustrates the work order creation subroutine of my invention:

FIG. 4L illustrates the message processing subroutine of my invention.

FIG. 4M illustrates the email subroutine of my invention.

FIG. 4N illustrates the open transaction review subroutine of my invention.

FIG. 4O illustrates a continuation of the pressure check subroutine of FIG. 4B.

FIG. 4P illustrates the hauler/technician web interface subroutine of my invention.

FIG. 4Q illustrates the customer web interface routine of my invention.

DETAILED DESCRIPTION OF THE INVENTION

Figure 1:
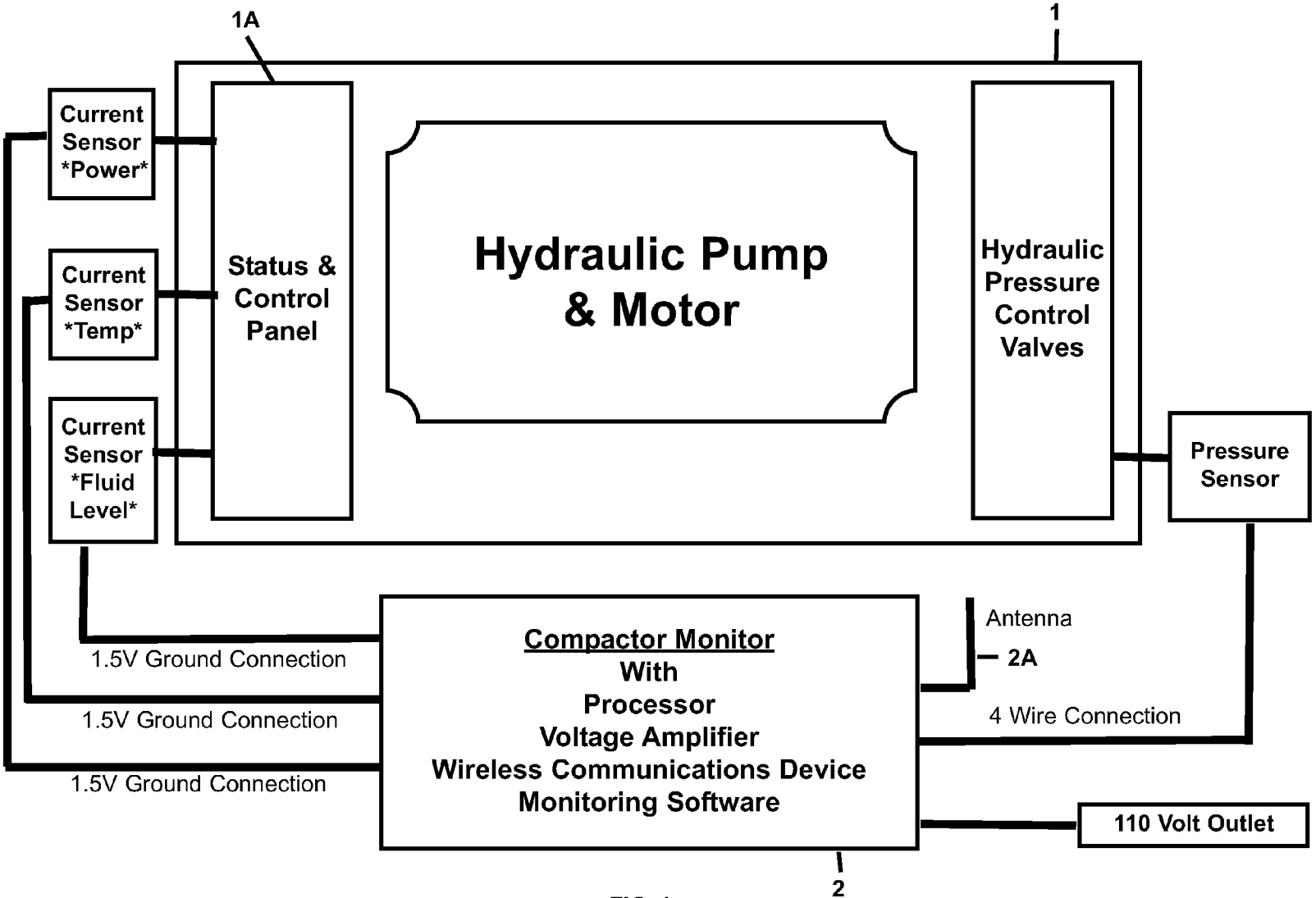
FIGS. 1, 2 and 3 provide an overview of the invention.
Figure 2:
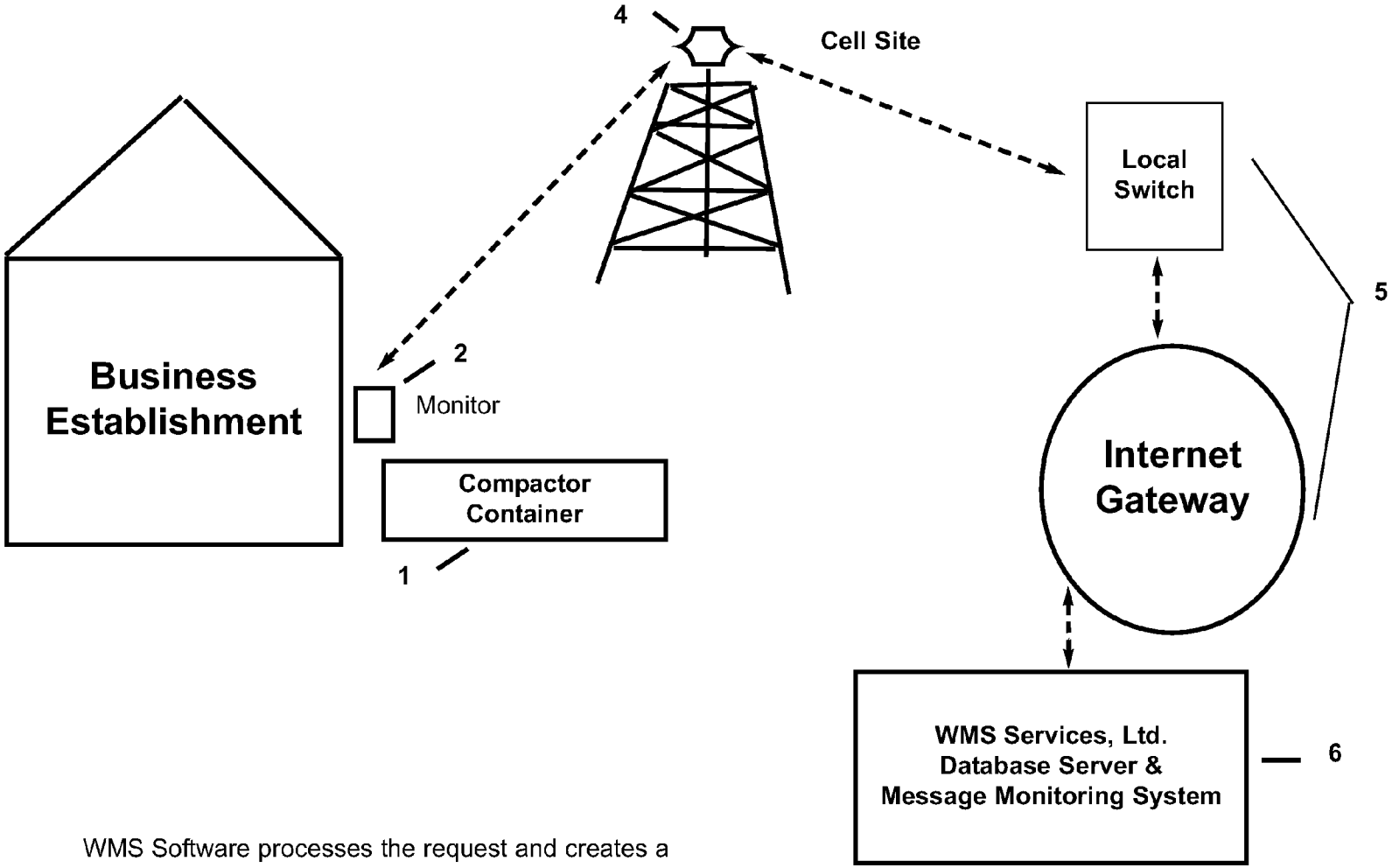

In the preferred embodiment of my invention described herein, certain elements are on-site and connected to the compactor being monitored, as illustrated primarily in FIGS. 1 and 2. Other elements are off-site, as illustrated primarily in FIG. 3. Still other features of my invention in operation are illustrated in FIGS. 4A through 4Q, which provide a detailed analysis and description of the operations of the systems included in my invention. All of these elements and features are important to the efficiency of the total system of my invention as more fully described below.

OVERVIEW OF INVENTION

Figure 3:
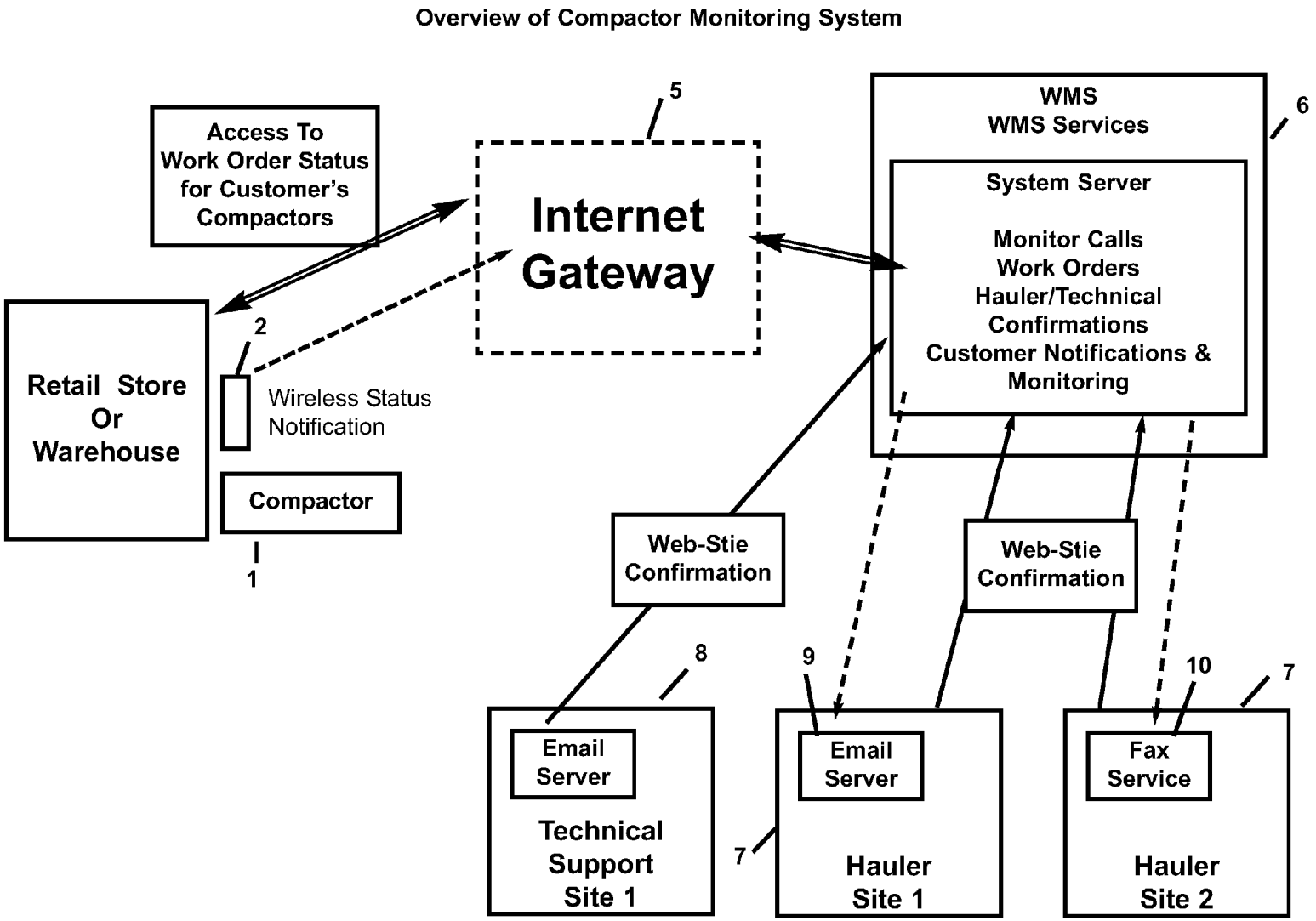
Figure 4A:
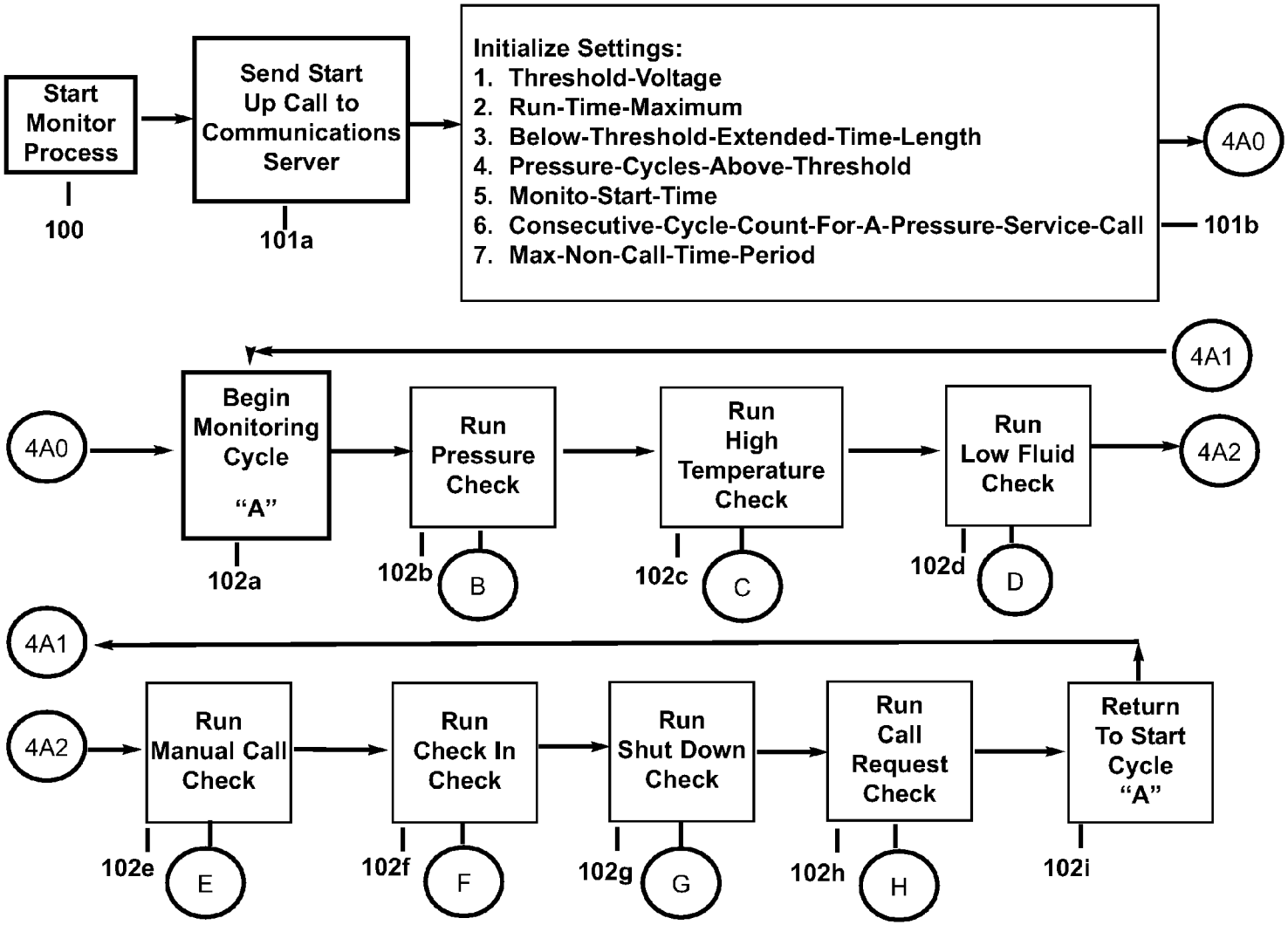
FIGS. 4A through 4H and 4O relate to the field monitoring aspects of my invention.

FIGS. 1 through 3 provide an overview of my invention. FIGS. 1 and 2 illustrate the manner and apparatus by which a compactor 1 is initially monitored using my invention and how a message (or registration) related to its operation is generated and sent. FIG. 3 illustrates both on-site and off-site elements, focusing particularly on the internet connection between the data server of my invention and service providers for the compactor 1.

At the heart of the functions illustrated in FIGS. 1 and 2—monitoring the fullness of compactor 1 and/or other critical parameters related to its performance and maintenance—is an on-site compactor monitor 2. Monitor 2 includes a processor, a wireless transmitter, an analog to digital convertor, an analog pressure sensor and on/off current sensors.

Monitor 2 can monitor numerous compactor parameters by the use of the on/off current sensors connected to various status lights ("idiot lights") on the compactor control panel 1A. Thus, as illustrated in FIG. 1, monitor 2 can easily be connected to status indicators for compactor power, high compactor hydraulic fluid temperature, and low hydraulic fluid level. The programmable processor of monitor 2 is capable of generating and sending a registration when any of the aforesaid parameters departs from optimal values for the compactor, as indicated by the "idiot light" to which the 2 is connected. It can also generate and send such registrations when the length of a compactor cycle is excessively long, when there has been no registration sent for a preset period, and/or when a switch on monitor 2 is manually triggered by the user/operator of the compactor 1.

In order to measure the fullness of compactor 1 my apparatus and system uses a very novel method and apparatus. An analog pressure sensor 3 is connected to the hydraulic fluid system for compactor 1. Pressure sensor 3 is capable of measuring hydraulic fluid system pressure for the compactor ram of compactor 1 during a compactor compaction cycle. Pressure sensor 3 provides a micro-voltage signal proportionate to the hydraulic fluid pressure in compactor 1 via an amplifier to the processor of monitor 2. The programmable processor of monitor 2 receives the signal generated by pressure sensor 3 during a compaction cycle and runs a software program monitoring the pressure indicated (along with the other parameters described above), and generates and sends a registration indicating the compactor is full when the pressure indicated is at least equal to a programmed preset pressure for a programmed preset time during a compaction cycle. The preset time and preset pressure are determined based on the nature of the waste being processed, and can be set when monitor 2 is initially installed.

The registrations generated by the processor of monitor 2 are conveyed initially via a wireless transmitter, preferably a cellular radio transmitter, using an antenna 2A of monitor 2. The use of a cellular radio transmitter is particularly advantageous because of the pre-existence of a sophisticated network for routing messages originating from cellular radio transmitters. Control channels are used by cellular systems to communicate information necessary for all call initiations (both incoming and outgoing) between the cellular system and the cellular customer. The message handling capacity of these control channels is far greater than is required by the cellular system, leaving sufficient capacity for data transfer unrelated to cellular telephone operation.

Turning to FIG. 3, it will be noted that this cellular radio message is picked up by a receiver 4 that is part of a wireless to internet communications network (denoted generally by bracket 5) and re-conveyed by the communications network 5 via internet to a computer server database system (database server 6) so that they can be appropriately processed. The registration sent by monitor 2 and received by server 6 contains the date/time of the message, the ID of the cellular radio transmitter, and the nature of the problem (i.e.—the parameters or indicators that the compactor requires servicing or repair). Database server 6 creates a work order transaction if the registration received indicates that the compactor requires service or repair. The two primary types of work order transactions types are for either an assigned hauler 7 to pull (i.e.—remove, dump, or replace) the compactor, or for the assigned technical maintenance staff/company 8 to service the unit. The database server 6 then creates and sends an email 9 including the work order to the appropriate hauler or service organization. Notification can also be provided by a facsimile message 10. If the customer has asked for a copy of all work orders, an email or facsimile is also sent to the appropriate email address for that customer.

Within the email transaction, a link is provided back to an access protected website provided by server 6 for tracking the servicing component of the transaction. Each service provider 7, 8 is provided with a PIN (personal identification number) or password allowing access to the website. The service provider 7, 8 uses the website to enter a projected date of service for the compactor pull or repair. Once the compactor is serviced, the service provider 7, 8 can re-enter the website to record the actual date of service (if different from the projected date of service) and the tonnage of the container. This is important as it allows monitoring of system performance in determining the fullness of the compactor/comtainer 1. Monitor 2 automatically resets all relevant parameters after the compactor 1 has been emptied by measuring the pressure of the unit during its next compaction cycle.

Detailed Analysis of System Routines and Operations

FIGS. 4A through 4Q provide a detailed analysis and description of the operations and routines included in my invention. These operations and routines can be most easily subdivided between those related to the field monitoring aspects of my invention (as further described in paragraphs A through H, below) and those related to the communication server aspects of my invention (as further described in paragraphs I through Q, below).

A. The field monitoring systems of my invention are more fully described and analyzed in FIGS. 4A through 4H and 4O. The main routine involved is best understood by reference to FIG. 4A. As illustrated in FIG. 4A, the main monitor routine repeats a set of instructions to check several values including sensor and program variables to determine a need to service the compactor. The primary service needs are either to empty the compactor because it is near full or to service the compactor based on a run condition that may indicate a maintenance issue. Below are the instruction steps the main routine performs:

1. At the point when the monitor is connected to a power source the following startup sequence occurs:
   a. As illustrated in operation block 101*a* of FIG. 4A, a call to the communications server is sent to indicate the device is up and running. This call provides a starting date/time reference for the check-in feedback process. The check in feedback process is a method to determine if there is a communication problem occurring at the Field Monitoring unit. The monitor is setup to check-in with the communications server based on a time parameter set in the software.
   b. As illustrated in operation block 101*b* of FIG. 4A, the next step is to initialize all parameter settings—The parameters are:
      i. Threshold Voltage—this is the value of voltage generated by the pressure sensor that indicates the container is full.
      ii. Run Time Maximum—this is the maximum length of time for the compactor to run between the time point when it is started and the time point when it shuts off. This is measured as a method to suggest a possible problem with the unit.
      iii. Below Threshold Extended Time Length—this value is an extension to the time length value for the last full indication time length. It combined with the last full time length as a determination value to indicate the container had been serviced (emptied).
      iv. Pressure Cycles above Threshold—this is the number of times the program must cycle while the pressure value is above the threshold voltage. (definition of pressure cycle: one read of the pressure voltage being produced by the pressure sensor)
      v. Monitor Start Time—this is the reference value used to determine if the monitor should send a check in message to the communications server
      vi. Consecutive Cycle Count for a Pressure Service Call—The number of consecutive compactor run cycles where the threshold voltage is reached and maintained for the pressure cycles above threshold length. Typically this value is one, but may change depending on the compactor unit environment.
      vii. Max Non-Call Time Period: This is the maximum time length to be checked against the current length of time since the last message was sent to the communication server. It is typically a week, but can be varied depending on the compactor unit environment and use.
2. At this point the monitoring software begins the normal monitoring of the compactor. The following routine calls are repeated while the monitor is in operation:
   a. Begin Monitoring. (See, FIG. 4A at operation block 102*a*).
   b. Run Pressure Check—This routine will monitor pressure of the pressure sensor while the compactor is operating. (See, FIG. 4A at operation block 102*b*).
   c. Run Temperature Check—This routine checks the status of the temperature sensor—if the sensor is not present, it is ignored. (See, FIG. 4A at operation block 102*c*).
   d. Run Low Fluid Check—This routine checks the status of the low fluid sensor—if the sensor is not present, it is ignored. (See, FIG. 4A at operation block 102*d*).
   e. Run Manual Call—This routine checks the status of the manual call button—if the sensor is not present, it is ignored. (See, FIG. 4A at operation block 102*e*).
   f. Run Check-In Check—This routine checks the length of time since the last message has been sent to the communications server. (See, FIG. 4A at operation block 102*f*).
   g. Run Shut Down Check—This routine checks the communication unit to see if a shutdown message had been received. (See, FIG. 4A at operation block 102*g*).
   h. Run Call Request Check—This routine checks to see if any of the above functions generated a call send request. (See, FIG. 4A at operation block 102*h*).
   i. End of Loop—Return to a, above. (See, FIG. 4A at operation block 102*i*).

Figure 4B:
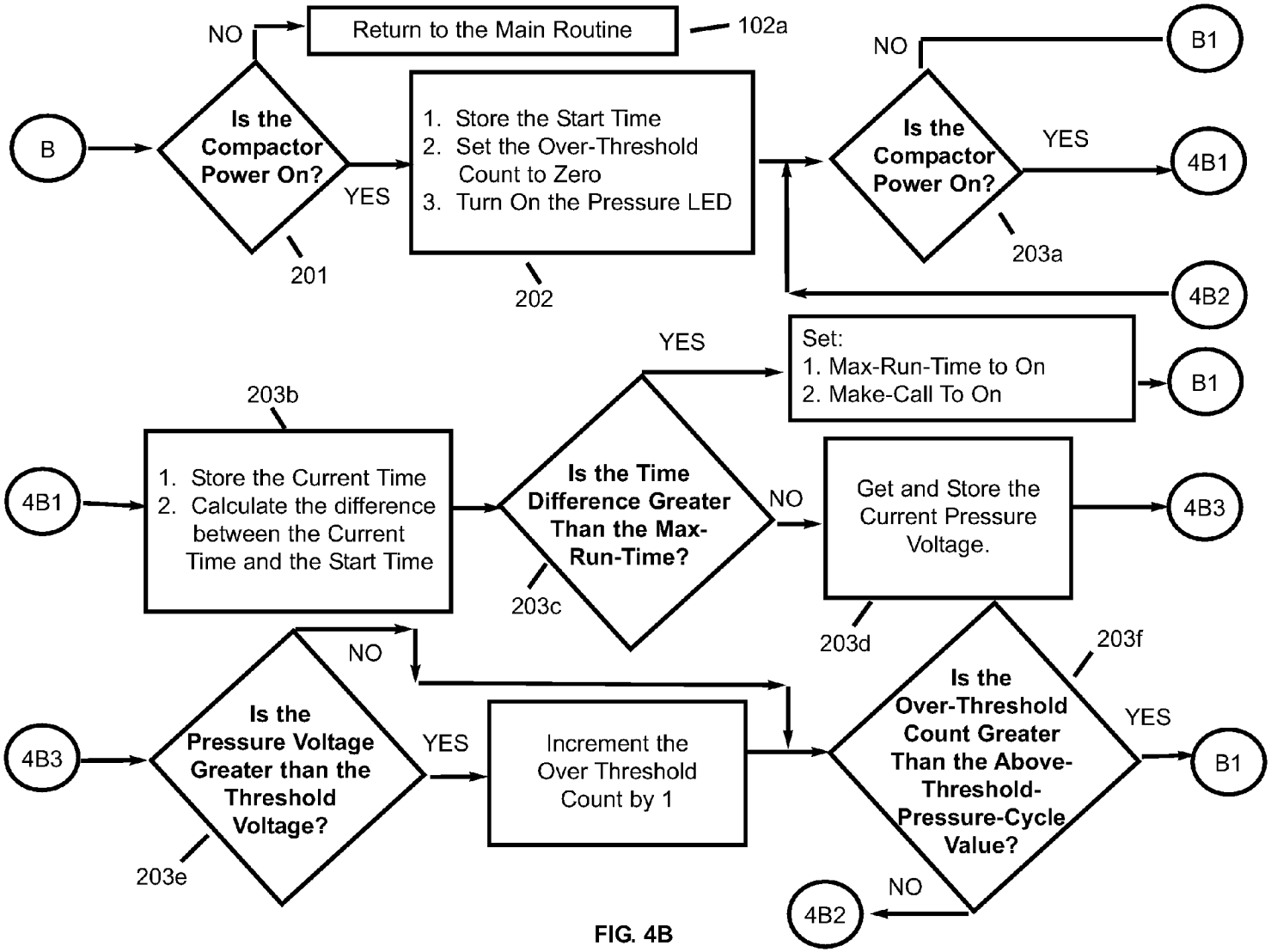
Figure 4C:
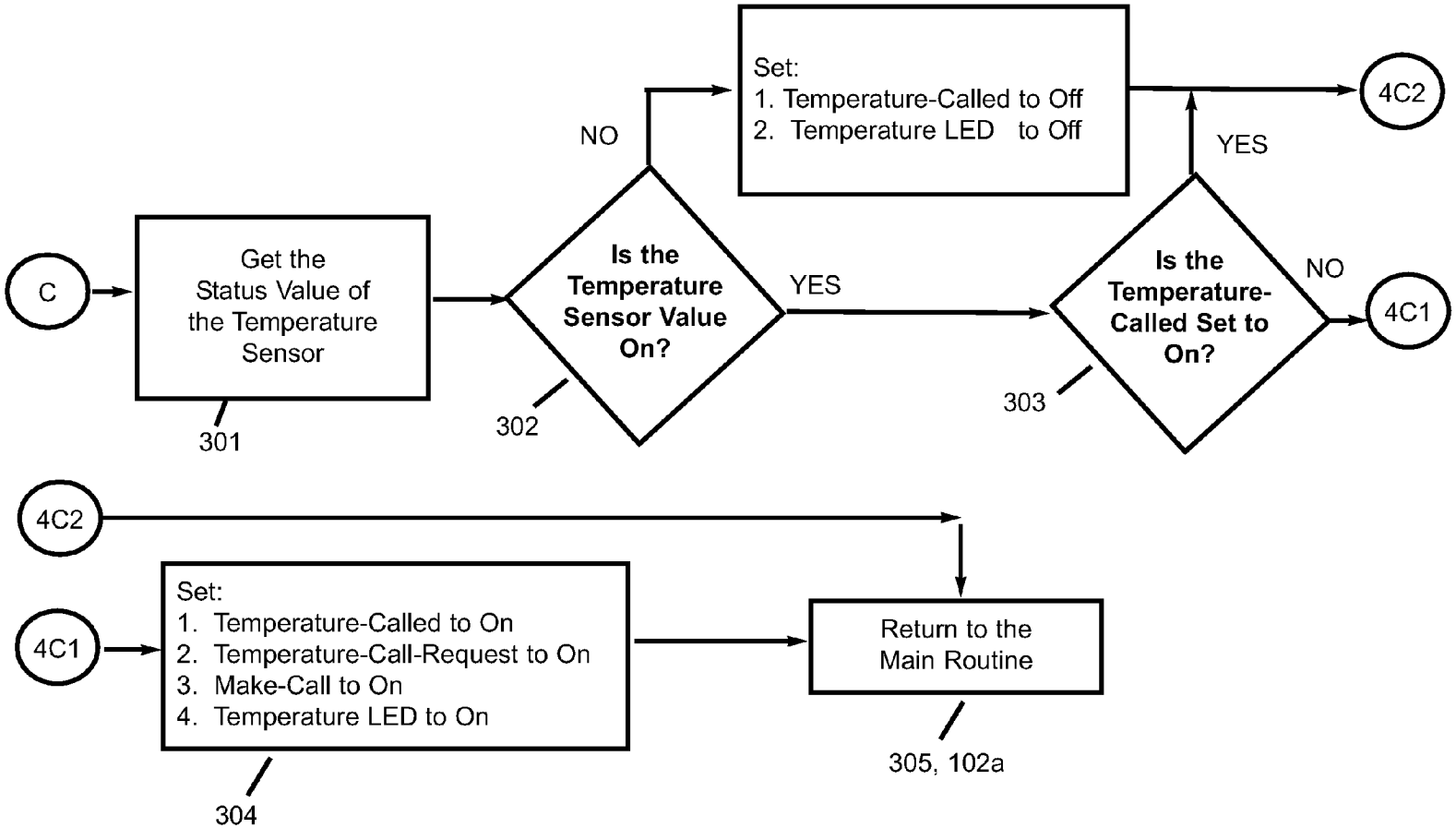
Figure 4D:
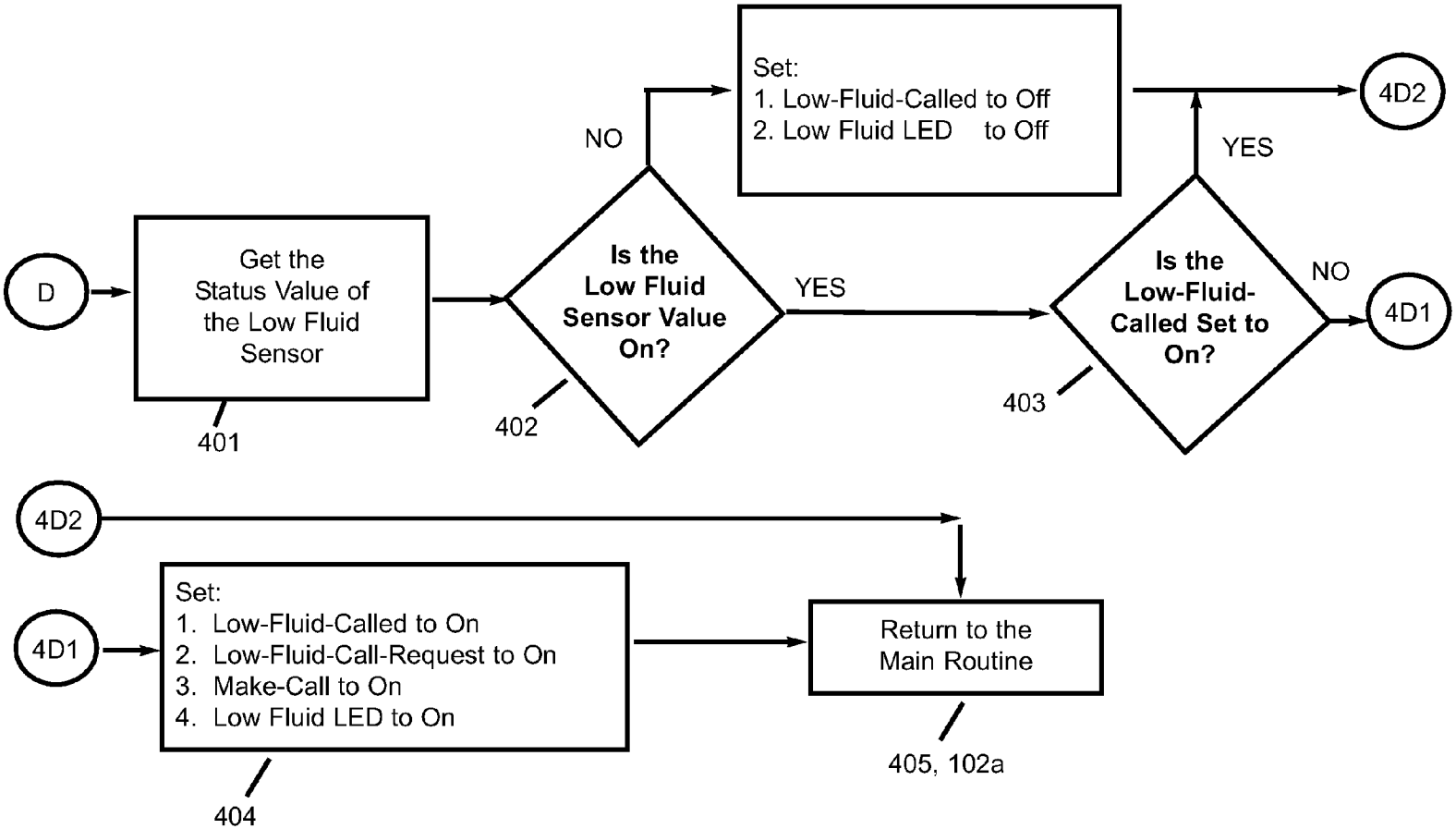
Figure 4E:
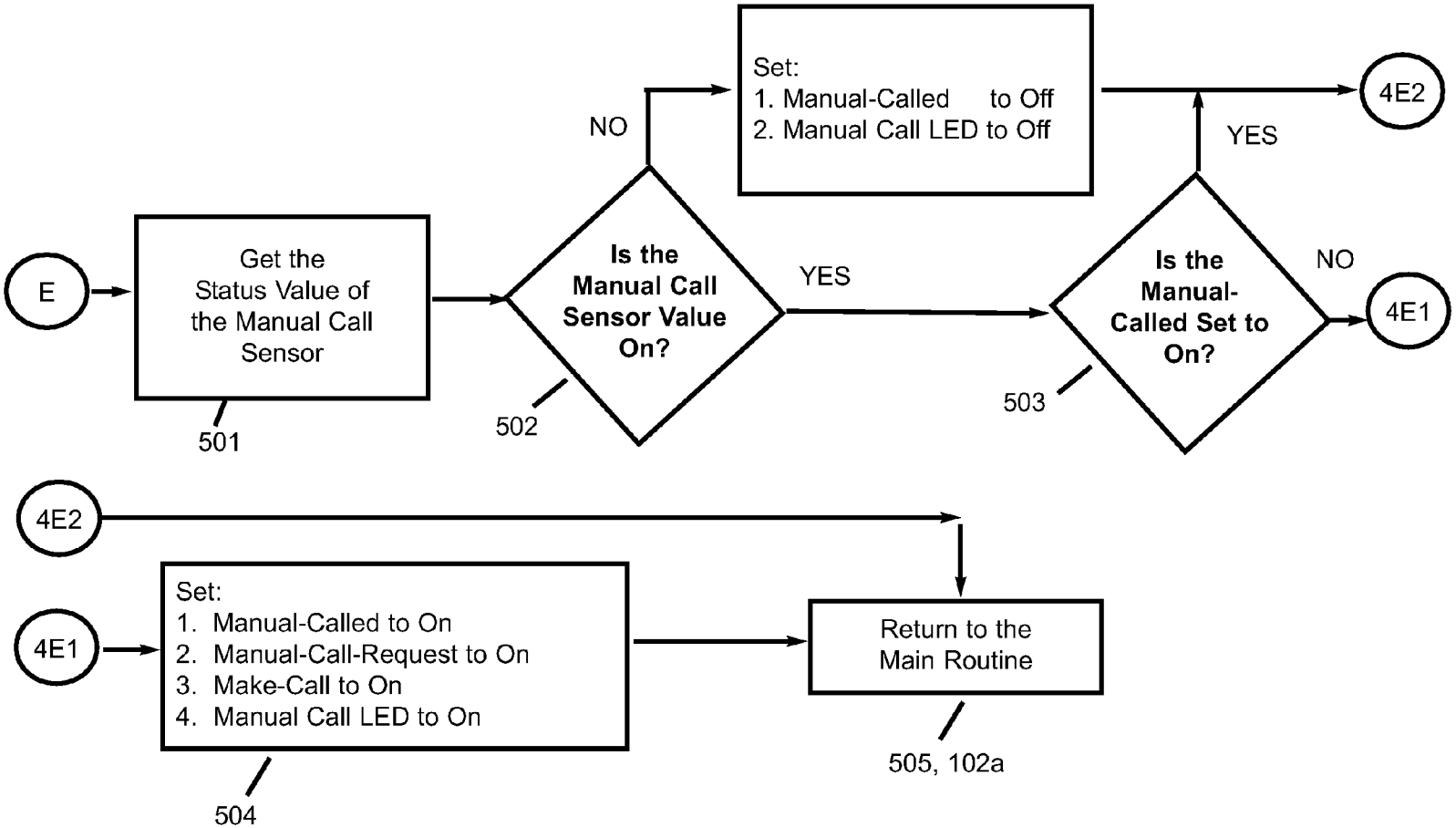
Figure 4F:
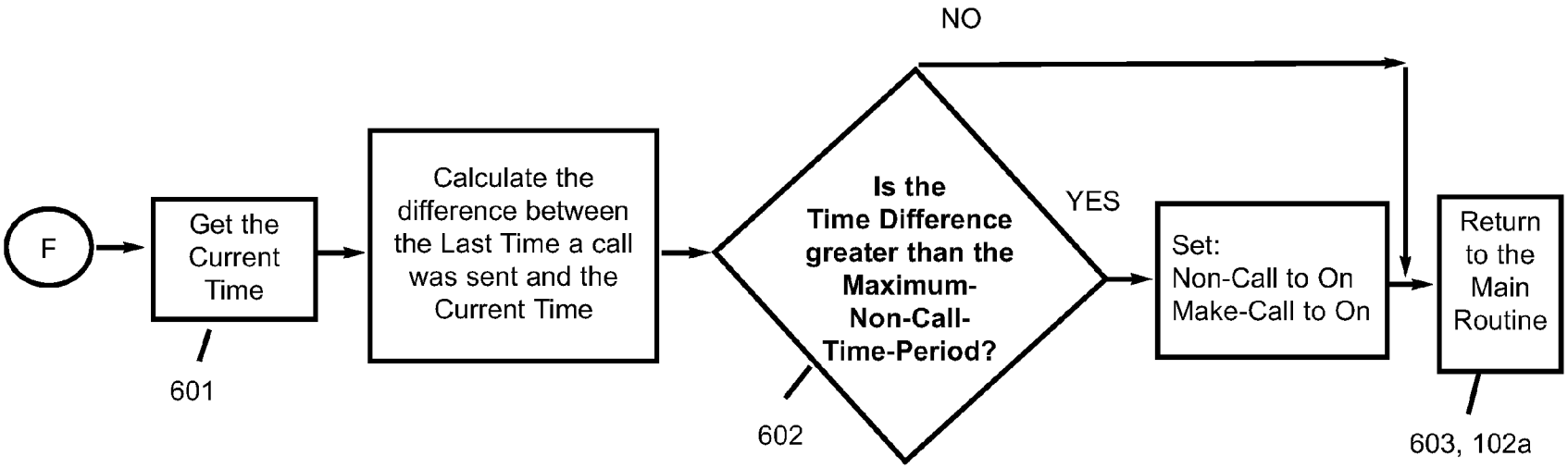
Figure 4G:
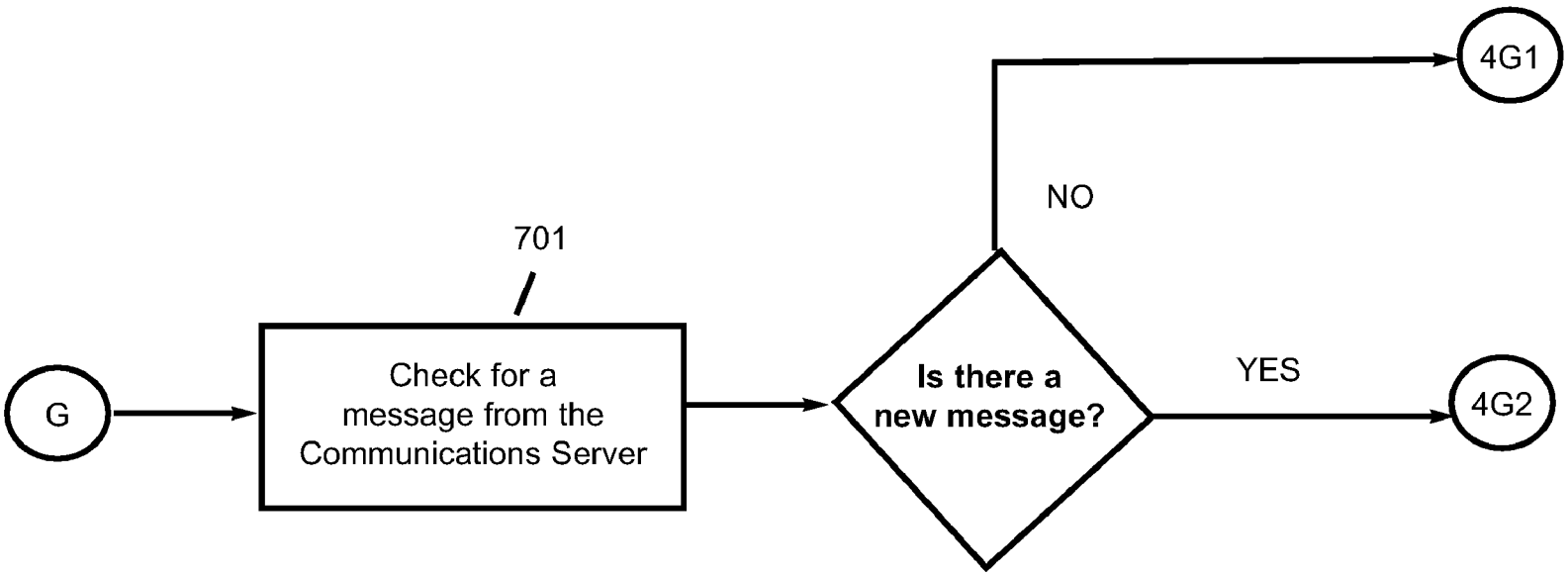
Figure 4G:
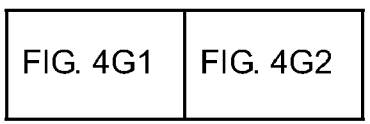
Figure 4H:
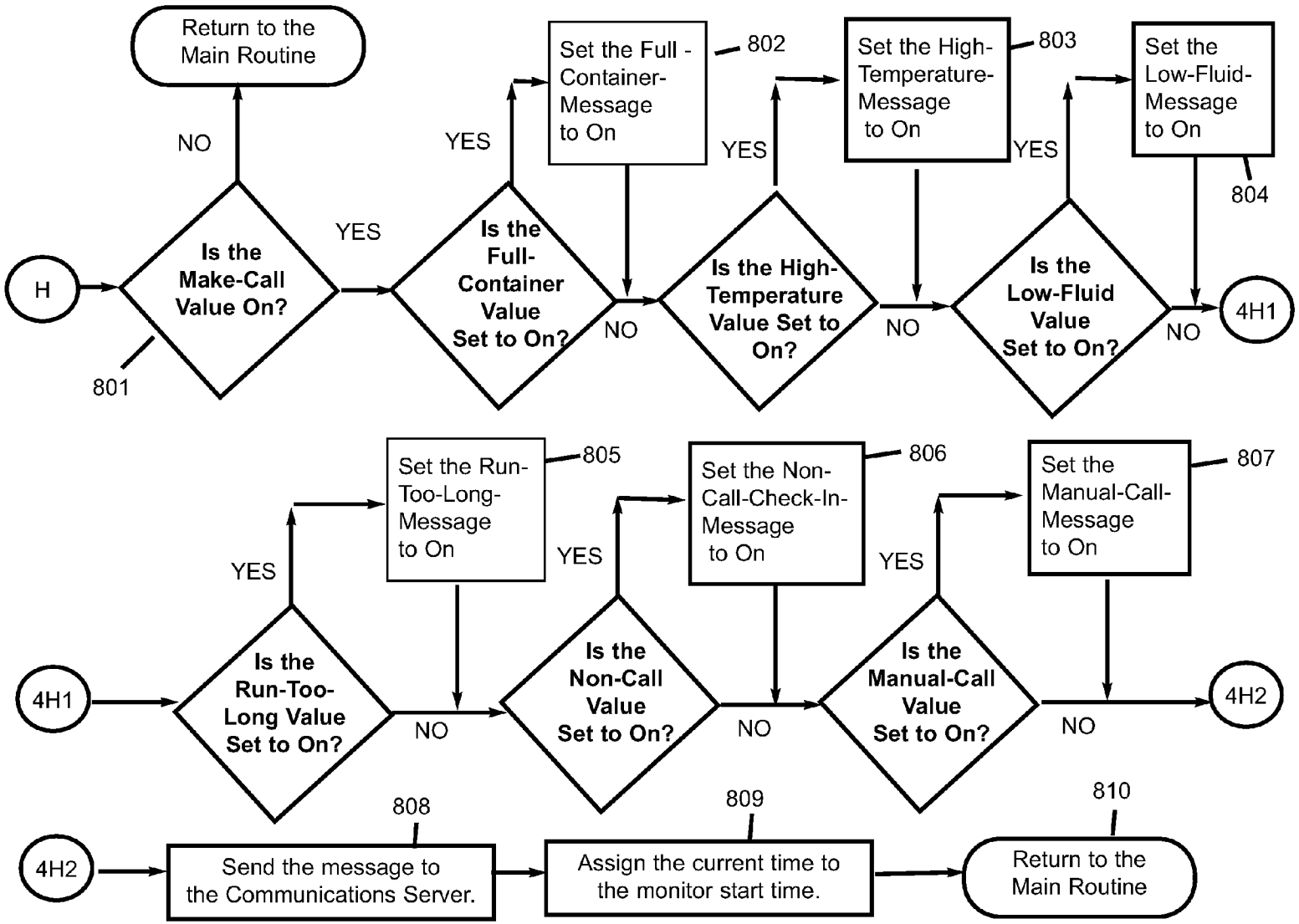

B. The pressure check subroutine referenced in subparagraph 2b, above (and illustrated in FIG. 4A at operation block 102*b*) is best understood by reference to FIG. 4B. The main purpose of this routine is to determine if the current continuous pressure reaches a threshold value indicating fullness and maintains that value for a time period indicating that it was not a spike of any kind. Thus a maintained pressure level above the set threshold point thus indicates the compactor is near full and should be emptied. The following instruction steps accomplish this task. The check for too long of a compactor cycle run is a secondary condition monitored within the pressure check routine. If the compactor run time exceeds a set value, the compactor may need servicing and the monitor will communicate that condition to the communications server and to the appropriate technical support contact. The instruction steps below accomplish these two monitoring tasks:

1. Check to see if the compactor is on, if not, return to the main routine, otherwise continue. (See, FIG. 4B at operation block 201).
2. Store the start time, set the over threshold counter to zero, turn off the pressure LED (red light on monitor control board). (See, FIG. 4B at operation block 202).
3. Begin measurement program loop
   a. Check to see if the compactor is still on, if not, go to B 1 (illustrated in FIG. 4O) otherwise, continue loop (See, FIG. 4B at operation block 203*a*).
   b. Calculate the difference between the current time and the start time to determine the time length of the run to this point. (See, FIG. 4B at operation block 203*b*).
   c. Is the time difference greater than the max run time value (as illustrated in FIG. 4B at operation block 203*c*):
      If it is then
         Set the max run time program switch to on.
         Set the make call switch to on.
         Go to B1 (illustrated in FIG. 4O).
      (At this point the compactor cycle has run beyond the max run time and an alert to the technical maintenance support team needs to be created)
      Otherwise Continue.
   d. Get and Store the current pressure sensor voltage. (See, FIG. 4B at operation block 203*d*).
   e. If the pressure voltage value is greater than the threshold voltage, then increment the Over Threshold Count by 1, otherwise continue. (See, FIG. 4B at operation block 203*e*).

f. If the Over Threshold Count is greater than the pressure cycles above threshold value, then go to B1 (illustrated in FIG. 4O), otherwise go to step 3a, above. (See, FIG. 4B at operation block 203*f*).

B1. The subroutine illustrated in FIG. 4O is a continuation of the Pressure Sensor process. It reviews the values established as a result of the operation of the compactor and sets appropriate program switch values as required. The following instruction steps complete the pressure monitoring process:

1. If the compactor is on, then continue to check until the unit turns off. (See, FIG. 4O at operation block 1501).
2. Take the difference between the current time and the start time and store the total run time. (See, FIG. 4O at operation block 1502).
3. If the max run time program switch is off and the over threshold counter greater than the pressure cycles above threshold value then continue, otherwise return to the main routine. (See, FIG. 4O at operation block 1503).
4. If the total run time is greater than the sum of the last run time plus the below threshold extended time length, then turn off the pressure already called program switch, otherwise continue. (See, FIG. 4O at operation block 1504).
5. If the total run time is less than the run time maximum value and the pressure already called program switch is off, then continue, otherwise set the completed runs above threshold value to zero, set the last run time value to the total run time this cycle and return to the main routine. (See, FIG. 4O at operation block 1505).
6. Increment the completed runs above threshold by 1. (See, FIG. 4O at operation block 1506).
7. If the completed runs above threshold is equal to Consecutive Cycle Count for a Pressure Service Call value, then set the full container program switch to on and set the make call program switch to on. (See, FIG. 4O at operation block 1507).
8. Set the last run time value to the total run time this cycle and return to the main routine. (See, FIG. 4O at operation block 1508).

C. The temperature check subroutine illustrated in FIG. 4C monitors the value of a temperature sensor that is attached to the compactor. If the temperature sensor is on, it may indicate a maintenance problem with the compactor and a call to the technical maintenance support staff will be generated. The instruction steps to accomplish this task follow:

1. Get the status value of the temperature sensor. (See, FIG. 4C at operation block 301).
2. If the temperature sensor switch is set to on then continue, otherwise set the temperature call program switch to off, set the temperature LED to off, return to the main routine. (See, FIG. 4C at operation block 302).
3. If the temperature called program switch is set to on, then return to the main routine. (See, FIG. 4C at operation block 303).
4. Set the following values (as illustrated in FIG. 4C at operation block 304):
   a. Temperature Called Program Switch to ON
   b. Temperature Call Request Program Switch to ON
   c. Make call program switch to ON.
   d. Temperature LED to ON.
5. Return to the main routine. (See, FIG. 4C at operation block 305).

D. A subroutine to check for a low fluid condition in the compactor is implemented in FIG. 4D. If the low fluid sensor is no, it may indicate a maintenance problem with the compactor and a call to the technical maintenance support staff will be generated. The instruction steps to accomplish this task follow:

1. Set the status value of the Low Fluid sensor. (See, FIG. 4D at operation block 401).
2. If the Low Fluid sensor switch is set to on then continue, otherwise set the Low Fluid call program switch to off, set the Low Fluid LED to off, return to the main routine. (See, FIG. 4D at operation block 402).
3. If the Low Fluid called program switch is set to on, then return to the main routine. (See, FIG. 4D at operation block 403).
4. Set the following values (as illustrated in FIG. 4D at operation block 404):
   Low Fluid Called Program Switch to ON
   Low Fluid Call Request Program Switch to ON
   Make call program switch to on
   Low Fluid LED to on
5. Return to the main routine. (See, FIG. 4D at operation block 405).

E. The subroutine illustrated in FIG. 4E will allow a staff member at the site of the compactor to generate a manual call for service. Either a key would be used or special code value entered to request a service call. In this case, the service center for the monitor service would call and verify the request with the customer site. A work order would be generated for the compactor once the service request is verified. The instruction steps to accomplish this task follow:

1. Get the status value of the Manual Call sensor. (See, FIG. 4E at operation block 501).
2. If the Manual Call sensor switch is set to on then continue, otherwise set the Manual Call called program switch to off, set the Manual Call LED to off, return to the main routine. (See, FIG. 4E at operation block 502).
3. If the Manual Call called program switch is set to on, then return to the main routine. (See, FIG. 4E at operation block 3).
4. Set the following values (as illustrated in FIG. 4E at operation block 504):
   Manual Call Called Program Switch to ON
   Manual Call Request Program Switch to ON
   Make call program switch to on
   Manual Call LED to on
5. Return to the main routine. (See, FIG. 4E at operation block 505).

F. The subroutine illustrated in FIG. 4F monitors how long it has been since the last message has been sent to the communications server. If the time period between the last message and the current date/time is greater than the preset check in time value, a call will be generated. This is a simple method to make sure the monitor is up and running properly. If for any reason, the communications server does not receive a message from a monitor unit within the normal time period, a log message will be generated for the monitor service staff. They will in turn contact the service site and check with the staff about the unit. The instruction sets that accomplish this task follow:

1. Get the current time and calculate the difference between the last time a message was sent and the current time. (See, FIG. 4F at operation block 601).
2. If the time difference is greater than the maximum non-call time period, then set the Non-Call program switch to on, set the make call program switch to on. (See, FIG. 4F at operation block 602).

3. Return to the main routine. (See, FIG. 4F at operation block 603).

G. The subroutine illustrated in FIG. 4G checks whether a request to shutdown or start up has been received from the communications server. The network service provider requires that we are able to shut down the unit from our remote site. This routine is for that purpose only. The instruction steps that accomplish this task follow:

1. Check for a message from the communications server. (See, FIG. 4G at operation block 701).
2. If there is a message and the current value of the shutdown program switch is on, then set the program switch to off. (See, FIG. 4G at operation block 702).
3. Else if there is a message and the current value of the shutdown program switch is off, then set the program switch to on. (See, FIG. 4G at operation block 703).
4. Return to the main routine. (See, FIG. 4G at operation block 704).

H. The subroutine illustrated in FIG. 4H generates a service request call back to the communications server. It sets up the request message based on the purpose of the call—the program switch values set at the time of the request. The instruction steps that accomplish this task follow:

1. If the make call program switch is set to off, then return to the main routine. (See, FIG. 4H at operation block 801).
2. If the full container program switch is set to on then set the registration message full value to on. (See, FIG. 4H at operation block 802).
3. If the temperature program switch is set to on then set the registration message temperature value to on. (See, FIG. 4H at operation block 803).
4. If the Low Fluid program switch is set to on then set the registration message low fluid value to on. (See, FIG. 4H at operation block 804).
5. If the Run Too Long program switch is set to on then set the registration message run too long value to on. (See, FIG. 4H at operation block 805).
6. If the Non Call program switch is set to on then set the registration message Non Call value to on. (See, FIG. 4H at operation block 806).
7. If the Manual Call program switch is set to on then set the registration message Manual Call value to on. (See, FIG. 4H at operation block 807).
8. Send the registration message to the Communications server. (See, FIG. 4H at operation block 808).
9. Assign the current time to the monitor start time. (See, FIG. 4H at operation block 809).
10. Return to the main routine. (See, FIG. 4H at operation block 8010).

I. The communication server of my invention includes two databases, the compactor registration receiver database referred to as the compactor database and the master communications database. The purpose of the compactor database is simply to store every registration received from any field monitor. To recap, the field monitor will send a registration for a variety of reasons including, start-up, check-in, full container, high fluid temperature, low fluid level, run is too long or any other test event not yet defined. This design allows staff to maintain the master communications database as needed without interfering with the business of receiving registrations. Below are the steps the New Registration Receiver routine performs (as further illustrated in FIG. 4I):

1. Watch for a registration from a field monitor. (See, FIG. 4I at operation block 901). This step is simply stated as leaving a telephone line open all the time. In this case the telephone line is an Internet connection to a service provider gateway. The procedure waits for a registration to process. When the service provider sends a registration, it first checks that the receiver procedure is listening and ready to receive a transaction. The receiver basically identifies itself to the service provider and receives a registration. The registration is the combined set of information including the id of the communications device, the date and time of the registration and up to 32 bits of information. (32 bits=4 bytes or 4 characters).
2. Next the procedure checks the registration against current registrations to make sure it is not a duplicate registration. (See, FIG. 4I at operation block 902). If the registration is a duplicate, the procedure returns to step 1 and listens for a new registration.
3. The procedure now checks to make sure the compactor database is on-line (available for the creation of a new registration record). (See, FIG. 4I at operation block 903).
   a. If the compactor database is not available, the procedure adds the registration information to a backup support file and returns to step 1 to listen for more registrations. (See, FIG. 4I at operation block 903*a*). The backup support file is used to update the database when it is returned to an on-line status.
   b. If the compactor database is available, the procedure creates a new compactor table record and stores the registration information in the appropriate fields of the table.

Figure 4I:
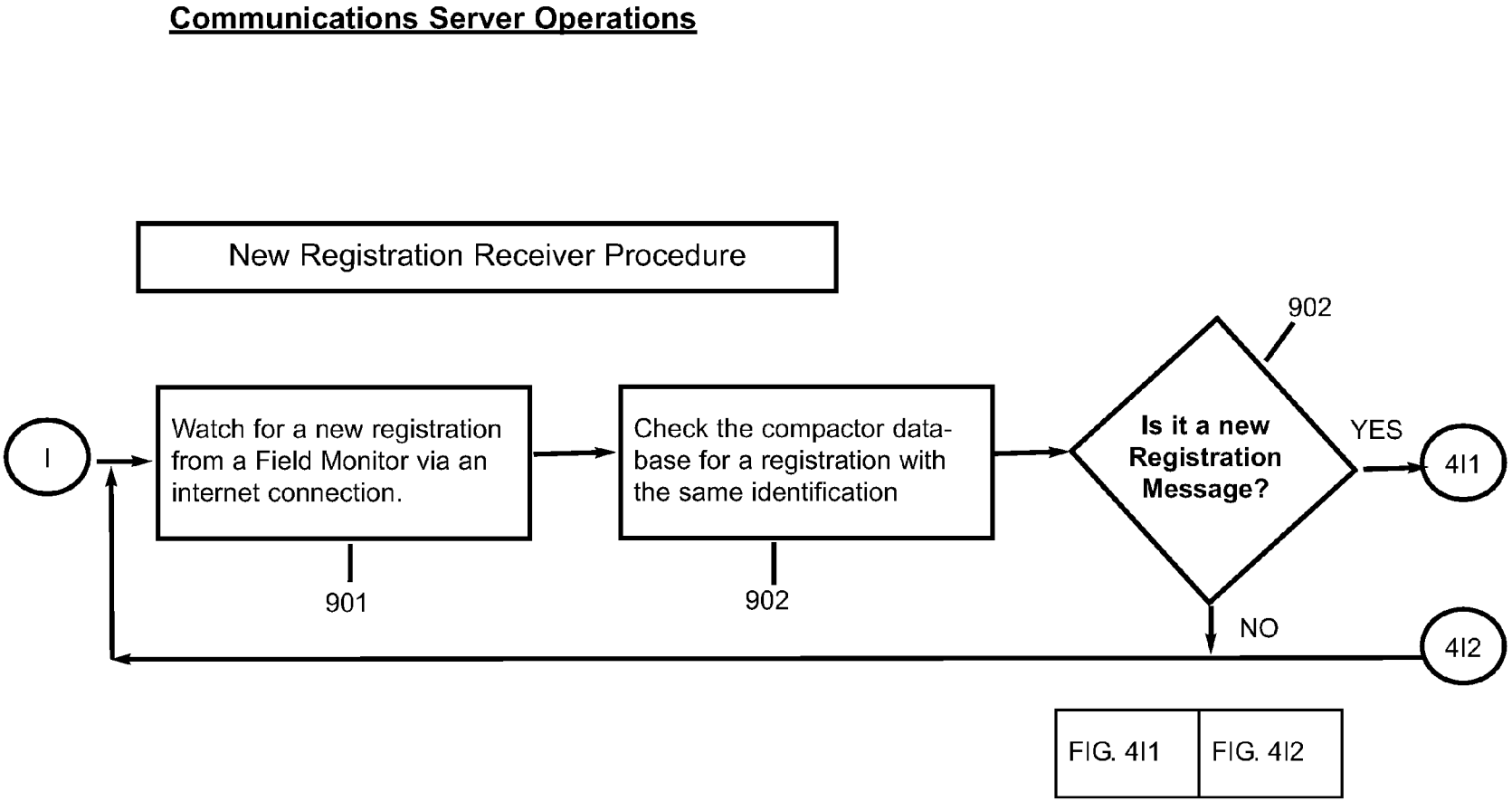

(See, FIG. 4I at operation block 903*b*). They include:

i. Communications device ID
   ii. Data String (32 bits)
   iii. Manual Call Switch
   iv. Check In Switch
   v. Run too Long Switch
   vi. Low Fluid Switch
   vii. High Temperature Switch
   viii. Container Full Switch
   ix. Number of seconds of run time
   x. Calendar Year
   xi. Calendar Month
   xii. Calendar Day The procedure then returns to step 1 above to listen for a new registration. (See, FIG. 4I).

Figure 4J:
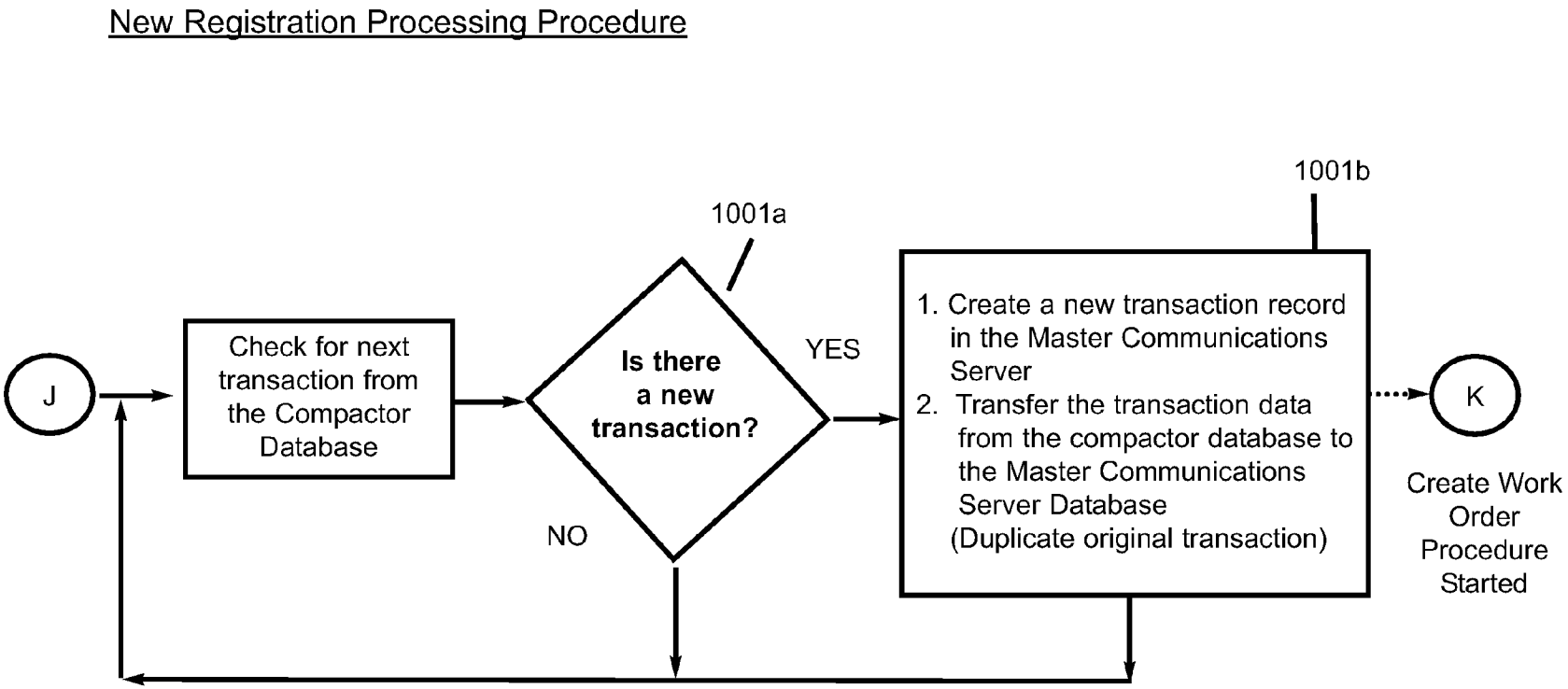

J. The new registration processing procedure monitors the compactor database table for the existence of new registrations. (See, FIG. 4J). It then processes the registration based on the information provided by the registration data. The primary job of this procedure is to route the message received to the appropriate personnel at the appropriate organization. For any single registration the message could be routed to the hauler, the technician who services the compactor, the customer who owns the monitor, the site manager where the compactor resides or to the service staff at the monitoring service. The procedure always formats the message to meet the needs of the message receiver. There are several sub-procedures that make up the total process. They are listed below:

1. Watch for the creation of a new transaction in the compactor database table.
   a. If there is no new transaction then continue to check for a new transaction. (See, FIG. 4J at operation block 1001*a*).
   b. If there is a new transaction then create an exact registration table record in the master communication database and then go back to watching for new registrations. (See, FIG. 4J at operation block 1001*b*).

This procedure although simple in purpose is the trigger for other procedural events to occur. The database system has been designed so that when one event occurs (the creation of a new registration record), other events can be started (the processing of the transaction data and the routing of the message to the appropriate receiver organization and staff). The next procedure (as outlined in paragraph K, below) is started as a result of the creation of the duplicate transaction record in the master communications server database.

K. The work order creation subroutine of my invention is illustrated in FIG. 4K, and includes the following steps:

1. Access the new registration record and use the communication device id (radio id) to find the customer service site record. Since each communication device has a unique id, it can be used to find the exact customer service site record in the database. (See, FIG. 4K at operation block 1101). The service site record stores a variety of key fields for routing the message to the appropriate receiver.
   a. If the customer service site is not available, the system creates a customer-service-site error message in the system error log. (See, FIG. 4K at operation block 1101*a*). The system error log is stored on the system and is printed out on a continuous form printer for review. A staff member at the monitoring service can either use the hard copy or the electronic copy as a working document to resolve the issue.
   b. If the customer service site is available, then continue the process. (See, FIG. 4K at operation block 1101*b*).
2. The system procedure next checks to see if all of the following switches are set to off (as illustrated in FIG. 4K at operation block 1102).:
   i. Full Container Value
   ii. High Temperature Value
   iii. Low Fluid Value
   iv. Run Too Long Value
   v. Non-Call Value
   vi. Manual Call Value If all the values are off, then the registration is a startup call from the monitor indicating the monitor has been plugged in for the first time, or power has been restored to the unit. The system records the date and time of the registration in the last start date and time fields of the customer service site table. It also creates a startup message log entry in the system log table for the monitoring service staff to review. If any value is set to on, the process continues.
3. Find the customer master site account record using the customer service site number. (See, FIG. 4K at operation block 1103 et seq.). The address information in this record is used to place within the work order transaction. It provides the necessary address information and instructions to locate the compactor by the service provider.
   a. If the customer master site account record is not available the procedure creates a missing customer master site account record message log entry in the system log table for the monitoring service staff to review and resolve.
   b. If the customer master site account record is available, then continue the process.
4. Find the customer master billing account record using the modified customer service site number. (See, FIG. 4K at operation block 1104 et seq.). The master billing account information is placed within the work order transaction to support the proper documentation of the services back to the primary customer corporate site at the time of the monthly service billing process by the monitoring service.
   a. If the customer master billing record is not available the procedure creates a missing customer master billing account record message log entry in the system log table for the monitoring service staff to review and resolve.
   b. If the customer master billing record is available, then continue the process.
5. A work order transaction record is created using the data from the following sources (as illustrated in FIG. 4K at operation block 1105):
   i. Registration Transaction
   ii. Customer Master Service Site Record
   iii. Customer Master Site Account Record
   iv. Customer Master Billing Account Record The status of this new transaction is set to open by the system.
6. The system now starts the message processing procedure (as further illustrated in FIG. 4L). This procedure performs the delivery process on the work order.

Figure 4L:
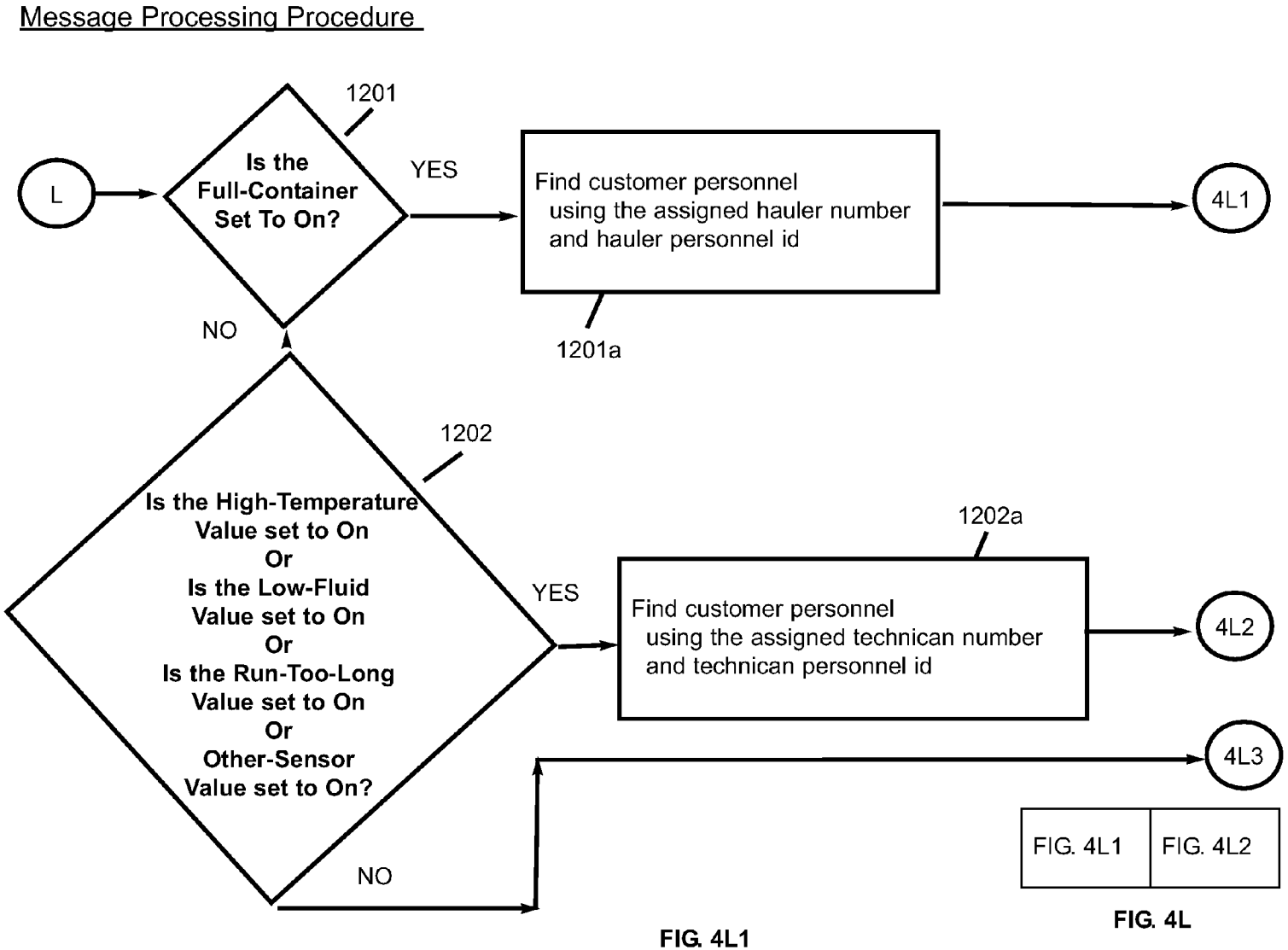

L. The primary purpose of the message processing procedure illustrated in FIG. 4L is to review the conditional values for a full container, high temperature, low fluid, run too long, manual call and non-call notice. If any of the values are set to on, the routine will develop the appropriate work order or log message and process the necessary actions for that value. The following conditional values are processed as listed below:

1. If the full container value is set to on then do the following (as illustrated in FIG. 4L at operation block 1201 et seq.):
   a. Find the appropriate personnel record using the hauler number and hauler personnel id assigned.
   b. Create in the email (text) format a work order document for the hauler assigned
   c. Call the email procedure to process the work order document and send the email notice to the hauler
2. If the high temperature value is set to on or
   . . . the low fluid value is set to on or
   the run too long value is set to on or
   the other maintenance sensor is set to on then do the following (as illustrated in FIG. 4L at operation block 1202 et seq.):
   a. Find the appropriate personnel record using the technician number and personnel id assigned.
   b. Create in the email (text) format a work order document to the technician assigned.
   c. Call the email procedure to process the work order document and send the email notice to the technician.
3. If the manual call value is set to on then do the following (as illustrated in FIG. 4L at operation block 1203 et seq.):
   a. Find the appropriate personnel record using the site contact number and personnel id assigned.
   b. Create a manual call log entry for the monitoring staff to process.

4. If the non-call value is set to on the do the following (as illustrated in FIG. 4L at operation block 1204 et seq.):
   a. record the date and time of the registration on the site record for this compactor. (This provides a historical record of non-call reports from the compactor).
   b. Create a non-call log entry for the staff to process. All non-call notices will be reviewed to ensure that there are no problems at the site. With regular use of the compactor, the non-call registration should be very rare.

Figure 4M:
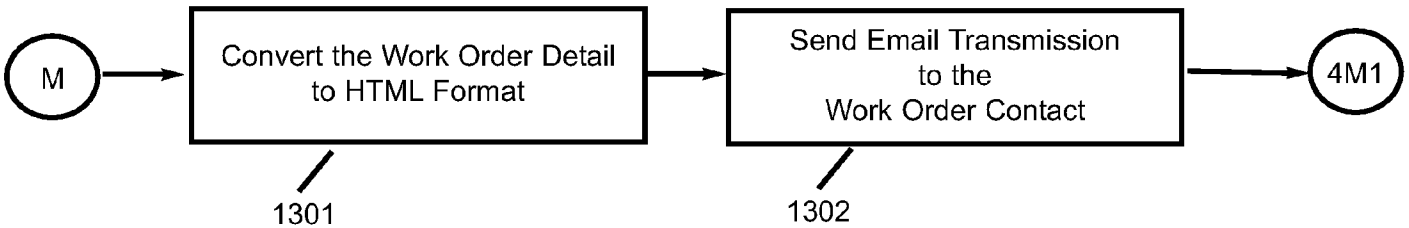
Figure 4M:
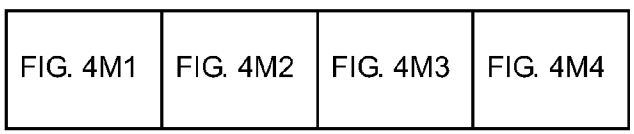

M. The email subroutine of my invention is illustrated in FIG. 4M. It includes the following steps:

1. Convert the email text format to HTML format to provide a better presentation of the work order. (See, FIG. 4M at operation block 1301).
2. Send the email to the appropriate work order recipient via the internet mail services. (See, FIG. 4M at operation block 1302).
3. Check to see if the transaction was processed successfully (as illustrated in FIG. 4M at operation block 1303 et seq.):
   a. If the message transmission failed then create an email failure log entry and send to the system log for staff review
   b. Otherwise continue
4. If the site record requires that a copy of the work order is sent to the customer, then do the following (as illustrated in FIG. 4M at operation block 1304 et seq.):
   a. Find the appropriate personnel record using the customer number and site contact personnel id assigned.
   b. If the customer site contact record is not available in the database then create a missing id for copy of work order log entry and send to the system log for staff personnel processing. Otherwise continue customer copy processing.
   c. Create a Customer Confirmation notice with the attached work order detail/copy.
   d. Send the email to the customer site contact.
   e. Check to see if the transaction was processed successfully:
      i. If the message transmission failed then create an email failure log entry and send to the system log for staff review
      ii. Otherwise continue.

Figure 4N:
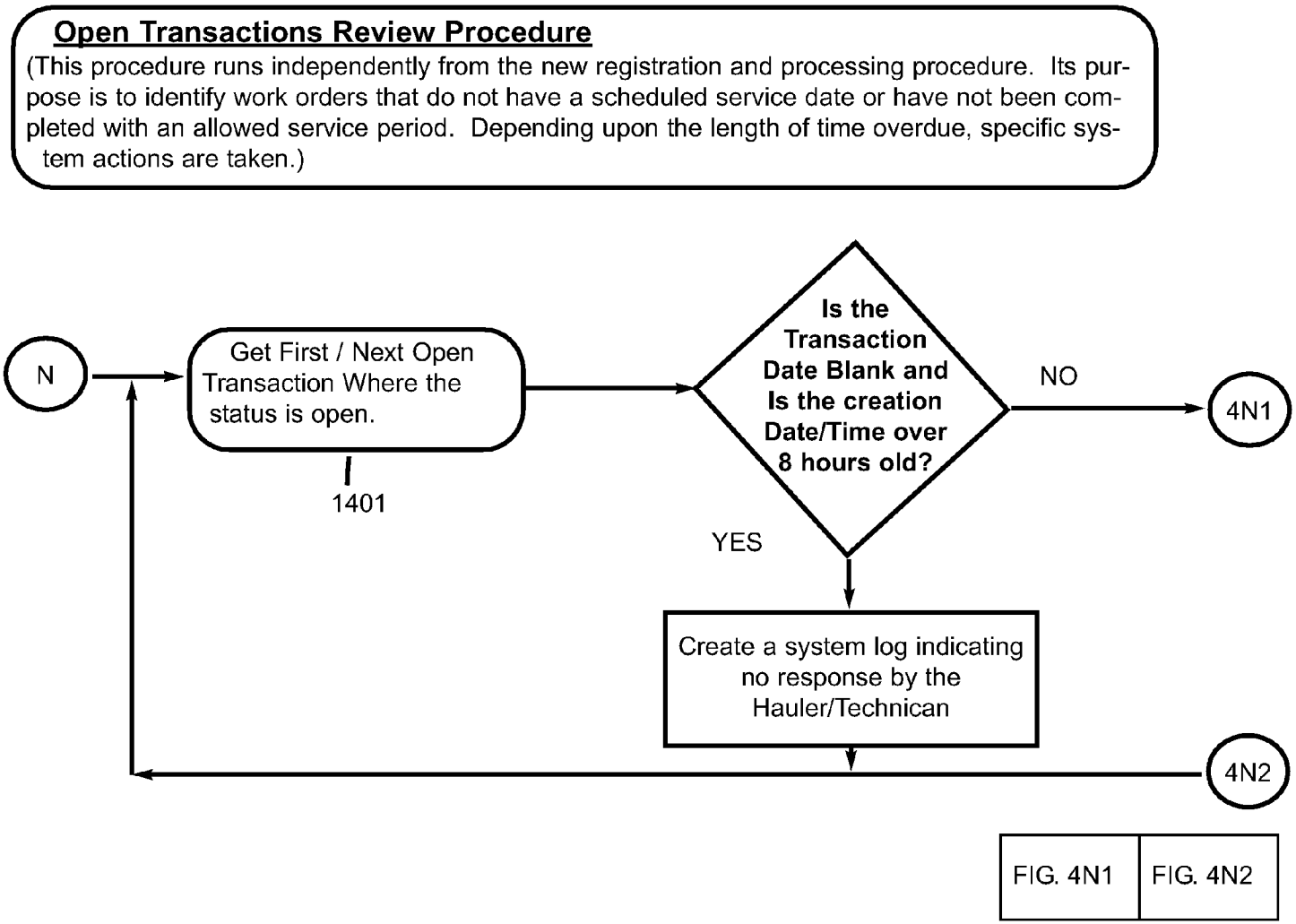
Figure 4O:
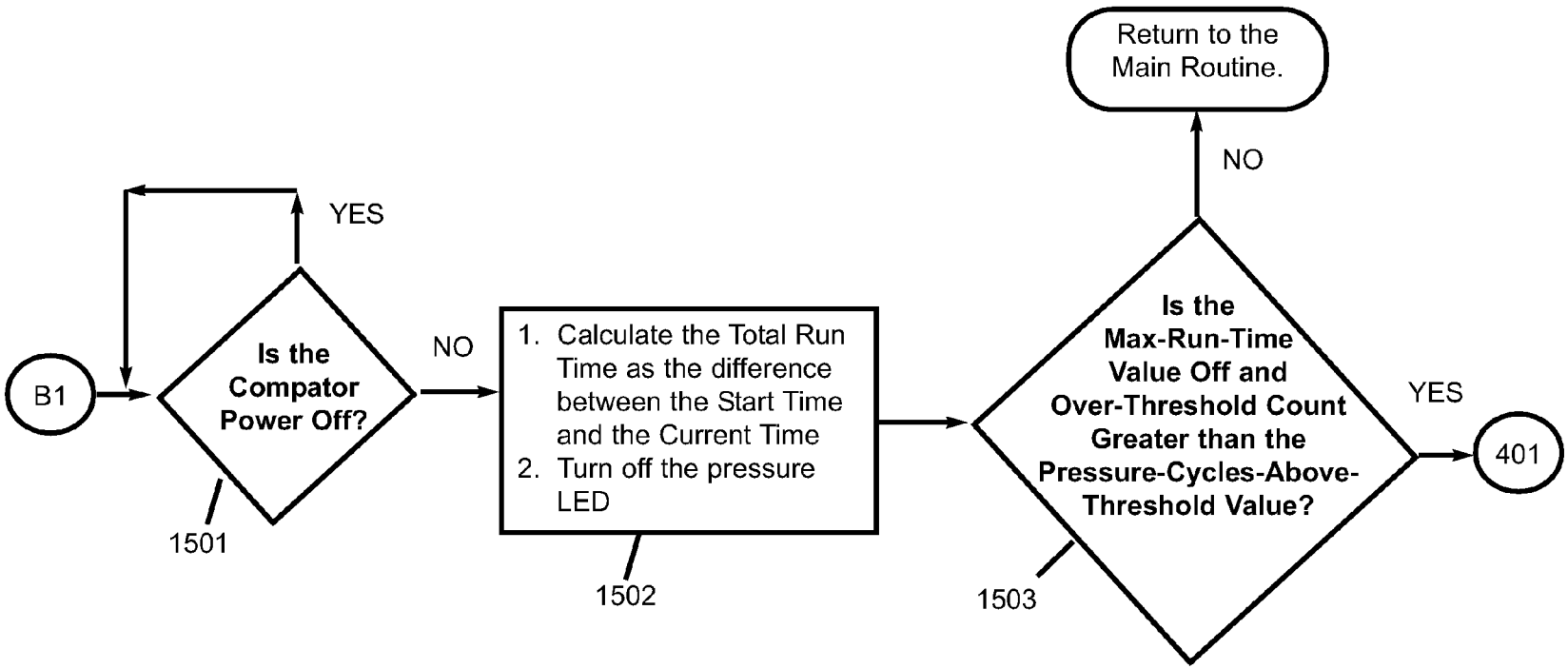
Figure 4O:
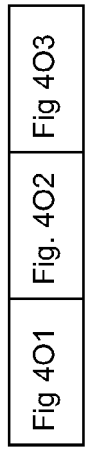

N. The open transaction review procedure routine of my invention is illustrated in FIG. 4N. The purpose of this procedure is to identify work orders that do not have a scheduled service date or have not been completed within an allowed service period. Depending on the length of the time overdue, specific actions are taken. This procedure will run independently on the master communications server. The following process (as illustrated in FIG. 4N at operation blocks 1401–1405) is continually repeated:

1. Get the first open work order transaction by checking the work order status value.
2. If the transaction date is blank and the creation date/time is over eight hours old then create a no response from hauler or technician log entry and send to the system log for staff processing, otherwise continue.
3. If the transaction date is blank and the creation date/time is over four hours old then:
   a. Create a second notice work order document
   b. Re-send the notice via email using the standard email procedure (as illustrated in FIG. M).
4. If transaction date is not blank and the difference between the planned service transaction date and today is more than two days then create a no-service by hauler/technician log entry and send to the system log for staff processing, otherwise continue
5. If the transaction date is not blank and the difference between the planned service transaction date and today is more than one day old then:
   a. create a no-service reminder notice with associated work order Send the notice via email using the standard email procedure (as illustrated in FIG. M).

O. The web feedback system of my invention is designed to allow the service company (Hauler or Technician) a method to provide feedback on the work order. It also allows the monitoring service provider to provide online feedback to their customers in regards to the status of service, for any of their compactors, at any of their sites. Security is built into the services via a login and password system. The flowchart narratives listed in paragraphs P and Q, below, provides the procedures for the feedback system.

Figure 4P:
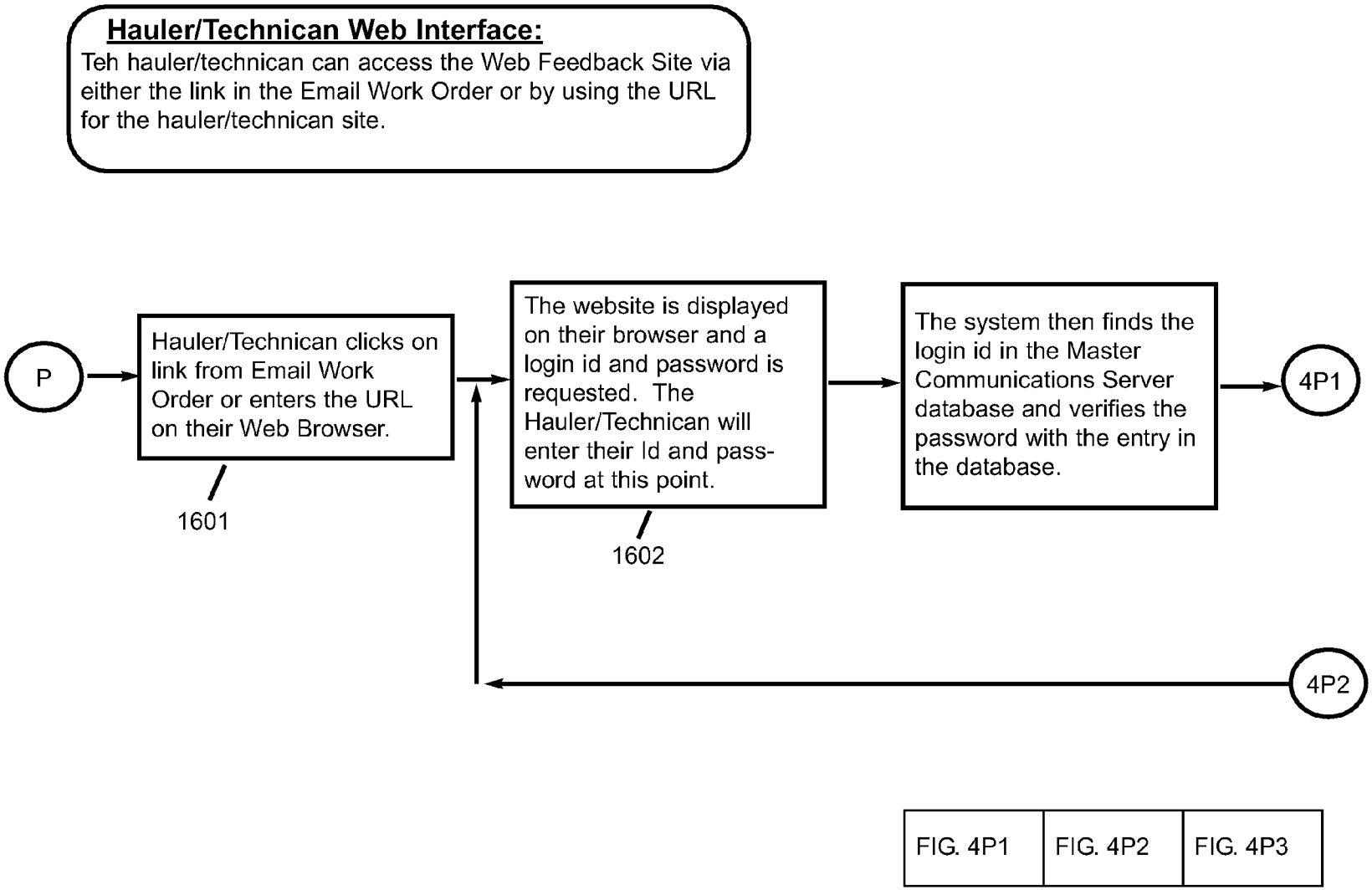
Figure 4Q:
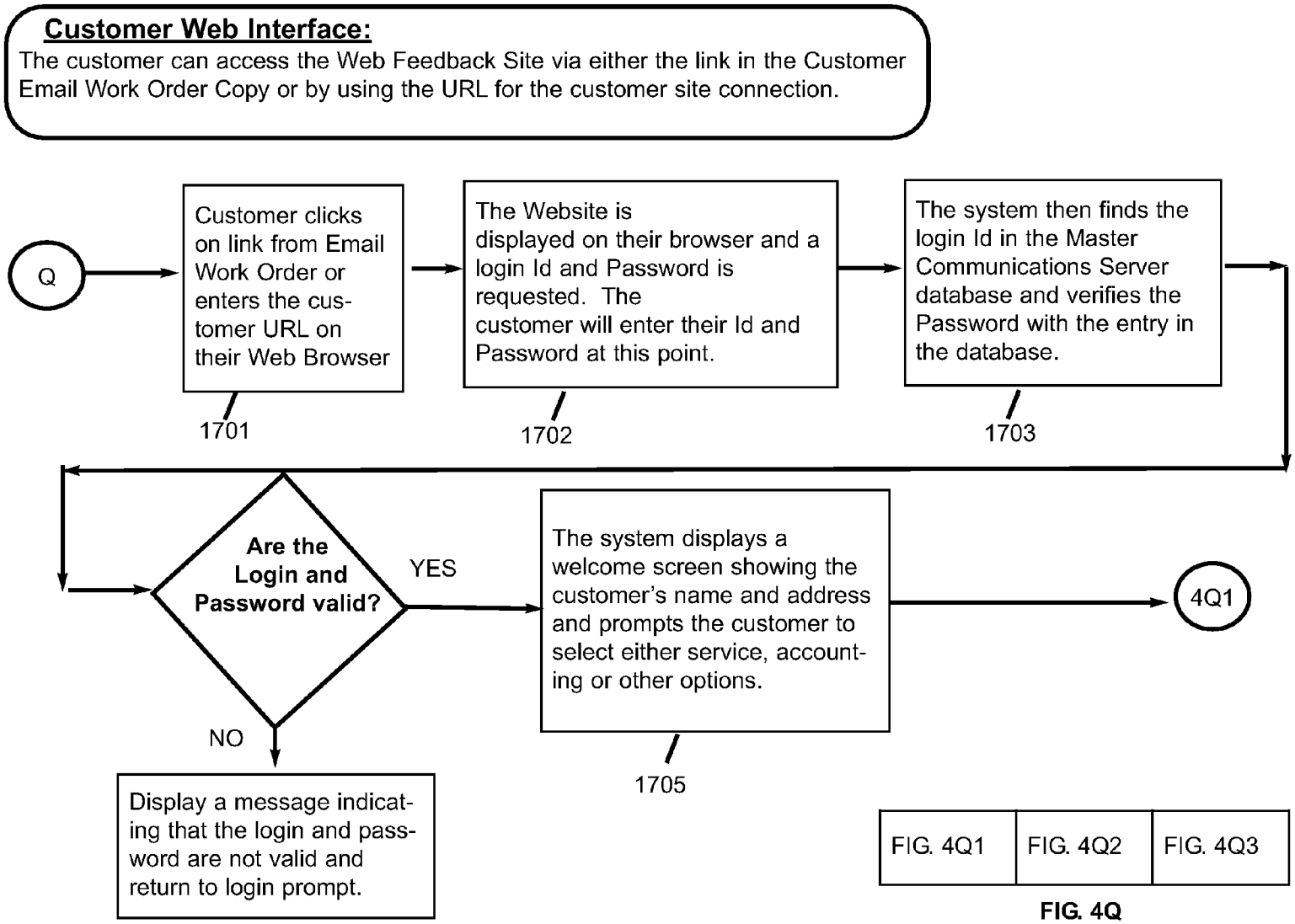

P. The hauler/technician web interface subroutine is illustrated in FIG. 4P. This interface is to allow the Hauler or Technician to provide pertinent information related to the servicing of the compactor. It is accomplished via two separate links to the web site. The first link is to enter the date of the planned service. The second link is to provide the actual service date/time, hauler ticket number and container weight and to close the work order by indicating the work has been completed. The following process narrative is provided:

1. The hauler/technician clicks on the link provided in the work order email message or enters the URL for the link into their web browser URL field.
2. The web site is displayed on the browser and a login id and password is requested. The hauler or technician enters their login id and password at this point. The login id and password are pre-assigned at the time the customer contracts for services.
3. If the login id and password are found to be valid on the master communications server the process continues. Otherwise the browser software will display an invalid login id and password and return to the login procedure.
4. Once a valid login id and password is verified, the browser will request the work order id to be updated. The hauler or technician enters the work order number listed on the received email at this time.
5. The web software then verifies that the work order is assigned to the hauler or technician assigned.
6. If the work order entered is not valid, the web software displays an invalid work order notice and returns to the work order number entry screen, otherwise the process continues.
7. The work order information is displayed on the web browser for verification purposes and the hauler or technician is prompted for the service date, time, and compactor weight. The hauler or technician can enter the appropriate information and then click either an update button to update the service date or the completed button to indicate the service is completed.
8. The web browser software confirms the change in the work order status with a display message. It then returns to the work order update screen. The hauler is allowed to enter other assigned work orders and to provide updated information.

If the log off button has been clicked, the web software returns to the login id and password step on the browser.

Q. The customer web interface routine of my invention is illustrated in FIG. Q. The customer can access the Web Feedback Site via either the link in the Customer Email Work order copy or by using the URL for the customer site connection. The customer feedback system is designed to allow the customer to check on the status of their compactor and their account with the monitoring service at any time. Via this service, the customer can check on any site account if they have a corporate password or just their own account if they have a customer site password. This provides the customer with a continual up to the minute report on the service the hauler or technician has provided. It also will show all open transactions. The following process narrative is provided:

1. The customer clicks on the link from the email work order copy or enters the customer URL on their web browser.
2. The web site is displayed on their browser and a login id and password is requested. The customer enters their login id and password at this point.
3. The web browser software then finds the login id and password on the master communications server
4. If the login id and password is not valid, the web browser software displays a message indicating an invalid login id and password. It then returns to the login id and password screen to allow the customer to re-enter their id. Otherwise the process continues.
5. The web browser software displays a welcome screen and displays the customer name and address. It then prompts the customer to select service, accounting or other options not yet created.
6. If the service option button is selected/clicked then proceed to the service information inquiry sub-system (illustrated in FIG. Q at Q1).
7. If the accounting option is selected/clicked then proceed to the accounting information inquiry sub-system (illustrated in FIG. Q at Q2).

Q1. Section Q1 of FIG. 4Q illustrates the service information inquiry sub-system of my invention. It includes the following steps:

1. The Sub-system will display the login site with a complete range of work order entries sorted by the work order number. The information displayed includes:
   a. Work Order Number—the number to track each work order sent to either the hauler or the technician
   b. Service Request Date—the date the work order request was created and sent to the hauler or technician
   c. Actual Service Date—the date the service was completed by the hauler or the technician
   d. Status—the status of the work order, O-Open or C-Closed. If the status is open and the actual service date is displayed, this date is considered the planned service date.
   e. Weight—this is the weight of the compactor reported by the hauler
   f. Manual Call Indicator—if this value is present, the site manager or staff member requested an on-demand pull of the compactor. All manual calls are verified by the monitoring service with the customer site manager before creating a work order.
   g. Manual Call Name—the staff enters the name of the person requesting the service via the manual call button.
2. Once the initial information is displayed, the customer can select:
   a. a different site and a new date range,
   b. a different date range for work orders
   c. the accounting button to go to the accounting information inquiry sub-system (as illustrated in section Q2 of FIG. 4Q)
   d. the log off button to leave the master communications server link
3. If the view button has been clicked the web browser software will use the current date and site settings to display the appropriate work order details. It will then allow the customer to review the data and select a new option as listed in step two above.
4. If the accounting information inquiry sub-system (Q2) button has been clicked, the web browser software will activate that software module.
5. If the log off button has been clicked, the web browser software will return to the customer login and password screen.

Q2. The accounting information inquiry sub-system of my invention is illustrated in section Q2 of FIG. 4Q. In includes the following steps:

1. The web browser software will display the current activity with a starting date of Jan. 1, 2000. The customer is then provided the opportunity to enter a different starting date to review the status of all invoices created by the compactor monitoring service. The accounting information displayed includes:
   a. Invoice Number—a transaction attached to the billed services for a specific invoice period, generally a month.
   b. Invoice date—this is the date the invoice was created and is used for aging the invoice.
   c. Invoice Code—this is a code associated with invoice transactions. They include but are not limited to DI-Invoice for service, CP-Cash Payment, DM-Debit Memo, CM-Credit Memo. Multiple transactions with the same invoice are netted (totaled) to show an open amount for that invoice.
   d. To Date Balance—this is a running balance for all transactions listed showing the net change in the balance from transaction to transaction.
2. The customer at this point can select:
   a. a different date range and show that information
   b. the service button to go to the service information inquiry sub-system (Q1).
   c. the log off button to leave the master communications server link
3. If the view button has been clicked the web browser software will use the current date and site settings to display the appropriate work order details. It will then allow the customer to review the data and select a new option as listed in step two above.
4. If the service information inquiry sub-system (Q1) button has been clicked, the web browser software will activate that software module.
5. If the log off button has been clicked, the web browser software will return to the customer login and password screen.

CONCLUSION

As will be clear from the foregoing, my invention includes novel and valuable methods and means facilitating the monitoring and servicing of compactors. However, numerous variations are possible without exceeding the scope of the inventive concept described herein. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A trash compactor monitoring system, comprising an on-site monitor for monitoring compactor pressure, the monitor including a pressure sensor for connection to the hydraulic fluid system of a compactor ram, the pressure sensor measuring hydraulic fluid system pressure for the compactor ram during a compactor compaction cycle; and a processor receiving measured pressure from the pressure sensor during said compaction cycle, the processor running a software program monitoring said measured pressure and generating and sending a message indicating the compactor is full if said pressure is at least equal to a preset pressure for a preset time during the compaction cycle.

2. A trash compactor monitoring system as described in claim 1, wherein said processor sends the message via the internet to a computer server database system that receives said message, creates a work order in response to the message, and sends said work order to an intended recipient via email, said email containing a link back to the database system for tracking services provided by the intended recipient.

3. A trash compactor monitoring system as described in claim 1, wherein said message is sent by a wireless transmitter to an off-site receiver that converts the message into an internet message.

4. A trash compactor monitoring system as described in claim 3, wherein a computer server database system receives said internet message, creates a work order in response to the message, and sends said work order to an intended recipient via email, said email containing a link back to the database system for tracking services provided by the intended recipient.

5. A trash compactor monitoring system, as described in claim 4, wherein said wireless transmitter is a cellular radio transmitter.

6. A trash compactor monitoring system, as described in claim 4, wherein said processor also generates and sends a message to an intended recipient in response to an other event.

7. A trash compactor monitoring system, as described in claim 6, said other event including at least one of when the compactor user manually generates a message via the monitor, when length of a compactor cycle is excessively long, when a low fluid indicator indicates low hydraulic fluid in the compactor, when a high fluid temperature indicator indicates high hydraulic fluid temperature in the compactor, and when there has been no message sent for a preset period.

8. A trash compactor monitoring system, as described in claim 6, wherein said message includes at least one of a date of the message, a time of the message, an identification of the transmitter, and an identification of the event.

9. A trash compactor monitoring system, as described in claim 4, wherein said hydraulic fluid system pressure sensor indicates pressure via an analog voltage signal, said voltage signal being proportionate to said pressure.

10. A trash compactor monitoring system, as described in claim 4, wherein said computer server database system identifies work orders that do not have a service date and identifies work orders that have not been completed within an allowed service period and provides notification to at least one of the intended recipient and an other.

11. A trash compactor monitoring system, as described in claim 4, wherein said database system includes a website such that said link to the database system provides access to the website so that a message recipient can log in and enter the date and weight of a compactor serviced, such that a compactor user can log in to check compactor servicing data, and such that a compactor user can check the status of an account with the message recipient servicing the compactor.

12. A trash compactor monitoring system, as described in claim 11, wherein said wireless transmitter is a cellular radio transmitter.

13. A trash compactor monitoring system, as described in claim 11, wherein said hydraulic fluid system pressure sensor indicates pressure via an analog voltage signal, said voltage signal being proportionate to said pressure.

14. A trash compactor monitoring system, as described in claim 11, wherein said computer server database system identifies work orders that do not have a service date and identifies work orders that have not been completed within an allowed service period and provides notification to at least one of the intended recipient and an other.

15. A trash compactor monitoring system, as described in claim 11, wherein said processor also generates and sends a message to an intended recipient in response to an other event.

16. A trash compactor monitoring system, as described in claim 15, wherein said message includes at least one of a date of the message, a time of the message, an identification of the transmitter, and an identification of the event.

17. A trash compactor monitoring system, as described in claim 15, said other even including at least one of when the compactor user manually generates a message via the monitor, when length of a compactor cycle is excessively long, when a low fluid indicator indicates low hydraulic fluid in the compactor, when a high fluid temperature indicator indicates high hydraulic fluid temperature in the compactor, and when there has been no message sent for a preset period.

18. A trash compactor monitoring system, as described in claim 17, wherein said wireless transmitter is a cellular radio transmitter.

19. A trash compactor monitoring system, as described in claim 18, wherein said message includes at least one of a date of the message, a time of the message, an identification of the transmitter, and an identification of the event.

20. A trash compactor monitoring system, as described in claim 19, wherein said hydraulic fluid system pressure sensor indicates pressure via an analog voltage signal, said voltage signal being proportionate to said pressure.

21. A trash compactor monitoring system, comprising:

a) an on-site monitor including a wireless transmitter capable of sending a wireless message via cellular control channel to a receiver, a sensor capable of measuring a compactor operation parameter, and a processor receiving said parameter from the sensor, the processor running a software program monitoring said parameter, and generating and sending a wireless message via said transmitter based on said parameter; and b) an off-site receiver that converts said wireless message sent via cellular control channel to an internet message.

22. A trash compactor monitoring system as described in claim 21, wherein a computer server database system receives said message, creates a work order in response to the message, and sends said work order to an intended recipient via email, said email containing a link back to the database system for tracking services provided by the intended recipient.

23. A trash compactor monitoring system, as described in claim 22, wherein said computer server database system identifies work orders that do not have a service date and identifies work orders that have not been completed within an allowed service period and provides notification to at least one of the intended recipient and an other.

24. A trash compactor monitoring system, comprising:

a) an on-site processor receiving a compactor operation parameter from a sensor, the processor running a software program monitoring said parameter, and generating and sending a message based on said parameter via the internet;

b) an off-site computer server database system that receives said message, creates a work order in response to the message, and sends said work order to an intended recipient via email; and c) wherein said email contains a link back to the database system for tracking services provided by said intended recipient.

25. A trash compactor monitoring system, as described in claim 24, wherein said computer server database system identifies work orders that do not have a service date and identifies work orders that have not been completed within an allowed service period and provides notification to at least one of the intended recipient and an other.

* * * * *